US010436217B2

(12) United States Patent
Aiello et al.

(10) Patent No.: US 10,436,217 B2
(45) Date of Patent: Oct. 8, 2019

(54) METHOD TO REDUCE ENTRANCE LOSSES TO INCREASE FAN INLET FLOW AND REDUCE ACOUSTIC NOISE

(71) Applicant: Apple Inc., Cupertino, CA (US)

(72) Inventors: Anthony Joseph Aiello, Santa Cruz, CA (US); Jesse T. Dybenko, Santa Cruz, CA (US); Richard A. Herms, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 1008 days.

(21) Appl. No.: 14/581,882

(22) Filed: Dec. 23, 2014

(65) Prior Publication Data

US 2015/0260198 A1 Sep. 17, 2015

Related U.S. Application Data

(60) Provisional application No. 61/953,701, filed on Mar. 14, 2014.

(51) Int. Cl.

| | |
|---|---|
| ***F04D 29/28*** | (2006.01) |
| ***F04D 29/42*** | (2006.01) |
| ***F04D 17/16*** | (2006.01) |
| ***F04D 25/06*** | (2006.01) |
| ***F04D 29/30*** | (2006.01) |
| ***F04D 29/44*** | (2006.01) |

(52) U.S. Cl.

CPC ..... *F04D 29/4213* (2013.01); *F04D 17/162* (2013.01); *F04D 25/0613* (2013.01); *F04D 29/281* (2013.01); *F04D 29/30* (2013.01); *F04D 29/424* (2013.01); *F04D 29/441* (2013.01); *F05D 2240/303* (2013.01); *F05D 2250/51* (2013.01)

(58) Field of Classification Search

CPC .... F04D 29/281; F04D 29/424; F04D 29/441; F04D 29/30; F04D 29/4213; F04D 29/28; F04D 25/0613; F04D 17/162; F04D 29/282

See application file for complete search history.

(56) References Cited

U.S. PATENT DOCUMENTS

| | | | | |
|---|---|---|---|---|
| 5,964,576 A * | 10/1999 | Fujita | F04D 29/282 415/206 |
| 6,345,956 B1 * | 2/2002 | Lin | F04D 29/282 415/119 |
| 2013/0236303 A1 * | 9/2013 | Teramoto | F04D 17/08 415/206 |

* cited by examiner

*Primary Examiner* — Kayla Mccaffrey

(74) *Attorney, Agent, or Firm* — Kilpatrick Townsend & Stockton LLP

(57) ABSTRACT

A cooling system for optimizing fan air flow performance without compromising acoustic performance is disclosed. At least three fan feature embodiments are disclosed: (1) sloped fan blades, (2) sloped impeller hubs, and (3) inlet flow guidance features. For the first embodiment, fan blades attached to an impeller disc and having leading edges that progressively curve toward a center of the impeller disc. For the second embodiment, the impeller disc is attached to and centered on an impeller hub that has a sloped hub surface that progressively curves toward the fan blades. For the third embodiment, an inlet flow guidance feature is positioned within a region surrounding a fan's inlet promoting smooth passage of air into the fan. In some embodiments, all three fan features are combined.

17 Claims, 19 Drawing Sheets

METHOD TO REDUCE ENTRANCE LOSSES TO INCREASE FAN INLET FLOW AND REDUCE ACOUSTIC NOISE

CROSS-REFERENCE TO RELATED APPLICATION

This application claims priority to U.S. Provisional Application Ser. No. 61/953,701 filed Mar. 14, 2014 entitled "Method To Reduce Entrance Losses To Increase Fan Inlet Flow And Reduce Acoustic Noise", which is incorporated herein by reference in its entirety.

FIELD

The described embodiments relate generally to methods and systems for optimizing fan air flow performance without compromising acoustic performance, and more particularly to methods and systems that use sloped fan blades, sloped impeller hub, and inlet flow guidance features for optimizing fan air flow performance without compromising acoustic performance.

BACKGROUND

Centrifugal fans are commonly used in computer systems and other electronic devices to provide cooling of the CPU (central processing unit), GPU (graphics processing unit) and other modules. Newer product generations typically introduce new features and/or faster processors that offer improved computing performance. These upgrades typically come with a cost of higher thermal loading on the system, which consequently requires increased air flow from the cooling fan to avoid overheating or throttling of processor performance to stay within sustainable temperature ranges. One way to increase the air flow and achieve the additional cooling required is to increase the maximum speed at which the fan is allowed to run in the system. Unfortunately, with higher speed comes higher air flow noise, which can have an undesirable impact on the user experience.

Therefore, it is desirable to optimize the fan air flow performance without acoustic performance.

SUMMARY

This paper describes various embodiments that relate to fans designed for optimal air flow and performance The fans described herein are well suited for incorporation into electronic devices, such as computers.

According to one embodiment, a fan optimized for air flow performance within a computing device is described. The fan includes an impeller hub. The fan also includes an impeller disc attached to the impeller hub. The impeller disc is centered with respect the impeller hub. The fan additionally includes a number of fan blades attached to the impeller disc in accordance with a circumference of the impeller disc. A leading edge of each of the fan blades facing the impeller hub is progressively curved toward a center of the impeller disc.

According to another embodiment, a fan optimized for air flow performance within a computing device is described. The fan includes an impeller hub. The fan also includes an impeller disc attached to the impeller hub. The impeller disc is centered with respect to the impeller hub. The fan further includes a number of fan blades attached to the impeller disc in accordance with a circumference of the impeller disc. The impeller hub has a concavely sloped surface that is progressively curved toward the fan blades.

According to an additional embodiment, a cooling system that is optimized for air flow performance within a computing device is described. The cooling system includes a fan that includes an impeller hub and an inlet. The cooling system additionally includes an inlet flow guidance feature positioned proximate the impeller hub and the inlet. The inlet flow guidance feature has a curved surface positioned relative to the inlet that promotes a smooth passage of air flow into the inlet. The inlet flow guidance feature is concentric with an axis of rotation of the impeller hub.

According to a further embodiment, a method for optimizing fan air flow performance within a computing device is described. The method includes using a number of sloped fan blades to generate air flow in a fan. The fan includes an impeller hub and an impeller disc attached to the impeller hub. The impeller disc is centered with respect to the impeller hub. The fan also includes a number of fan blades attached to the impeller disc in accordance with a circumference of the impeller disc. A leading edge of each of the plurality of fan blades facing the impeller hub is progressively curved toward a center of the impeller disc.

These and other embodiments will be described in detail below.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1:
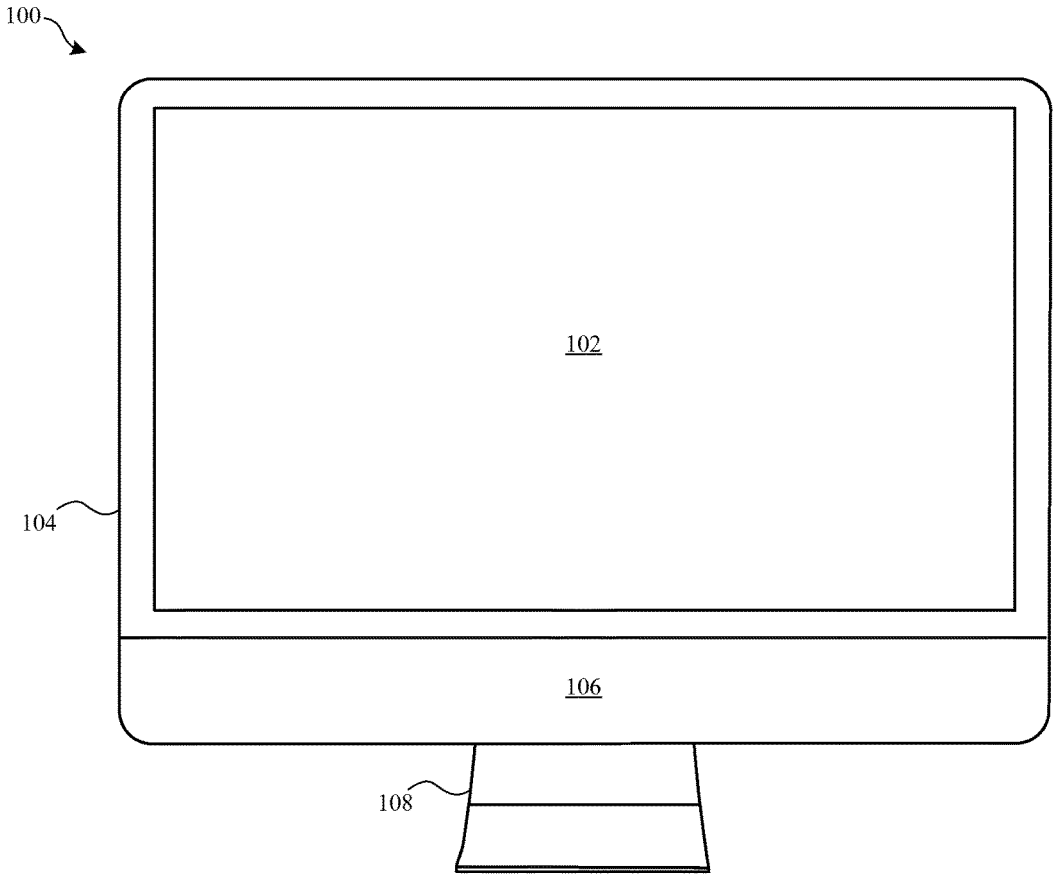
FIG. 1 shows a front view of a computing device for which described embodiments can be applied to optimize fan air flow performance without compromising acoustic performance.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

One way to optimize the tradeoffs between air flow and acoustic noise is to optimize the dimensional parameters of the fan, including the inlet size, blade dimensions, scroll wall shape, etc. These types of optimization studies are commonly done in the initial design of a given fan. In cases where a computer system employs an already-optimized fan and a fixed amount of space, there are few options available to the designer for increasing the air flow without trading off acoustic performance One option to achieve this performance increase is to slope the leading edge of the impeller blades such that the inner diameter of the blades encroaches into the inlet zone of the fan. This approach has the disadvantage of impeding air ingestion at the inlet, which can counteract the benefit of increasing the overall blade surface area, resulting in no net gain in performance.

Embodiments described herein address these issued by providing fans with features that allow for optimal airflow. In a first embodiment, leading edges of blades of the fans are progressively slope so that they provide additional blade surface area in a region where inlet encroachment has little impact on impeding air ingress through the fan inlet. The intent is to introduce little or no blade encroachment in the region of the fan where the air is being turned into the impeller blade zone, which is highly sensitive to inlet head loss. The desired result is overall increased air flow without requiring the increase in fan rotational speed associated with degraded acoustic performance. In a second embodiment, air flow performance is increased by providing an impeller hub that progressively slopes outward toward the fan blades. This can also provide improved air flow without trading off acoustic performance of the fan, similar to the progressively sloped fan blades. In a third embodiment, an inlet flow guidance feature is added in the region of a fan's primary inlet to improve air flow through the fan.

Accordingly, there can be three embodiments for optimizing fan air flow performance without compromising acoustic performance. The three embodiments are: (1) progressively sloped fan blade leading edges, (2) progressively sloped impeller hub, and (3) inlet flow guidance feature. Each of these three embodiments can be used as a separate, individual means for optimizing fan air flow performance without compromising acoustic performance by reducing entrance losses in the fan inlet zone. In some cases, two or more of these three embodiments are used in combination to achieve greater optimization. As such, the various aspects, embodiments, implementations or features of the three described embodiments can be used separately or in any combination.

These and other embodiments are discussed below with reference to FIGS. 1-18. However, those skilled in the art will readily appreciate that the detailed description given herein with respect to these Figures is for explanatory purposes only and should not be construed as limiting.

FIG. 1 shows a front view of a computing device 100 for which embodiments described herein can be applied to optimize fan air flow performance without compromising acoustic performance Computing device 100 contains a display portion 102, which can be made from any suitable display technology such as liquid crystal display (LCD), or organic light emitting diode (OLED) technology. Display portion 102 is covered and protected by display cover 104, which can be made of any suitable thin translucent material such as glass or hardened plastic. As shown, display cover 104 can extend past the edges of display portion 102, giving the top portion of computing device 100 a uniform appearance. Enclosure 106 encases display portion 102 and includes mounting means for attaching display cover 104. Enclosure 106 is supported by stand 108.

Figure 2:
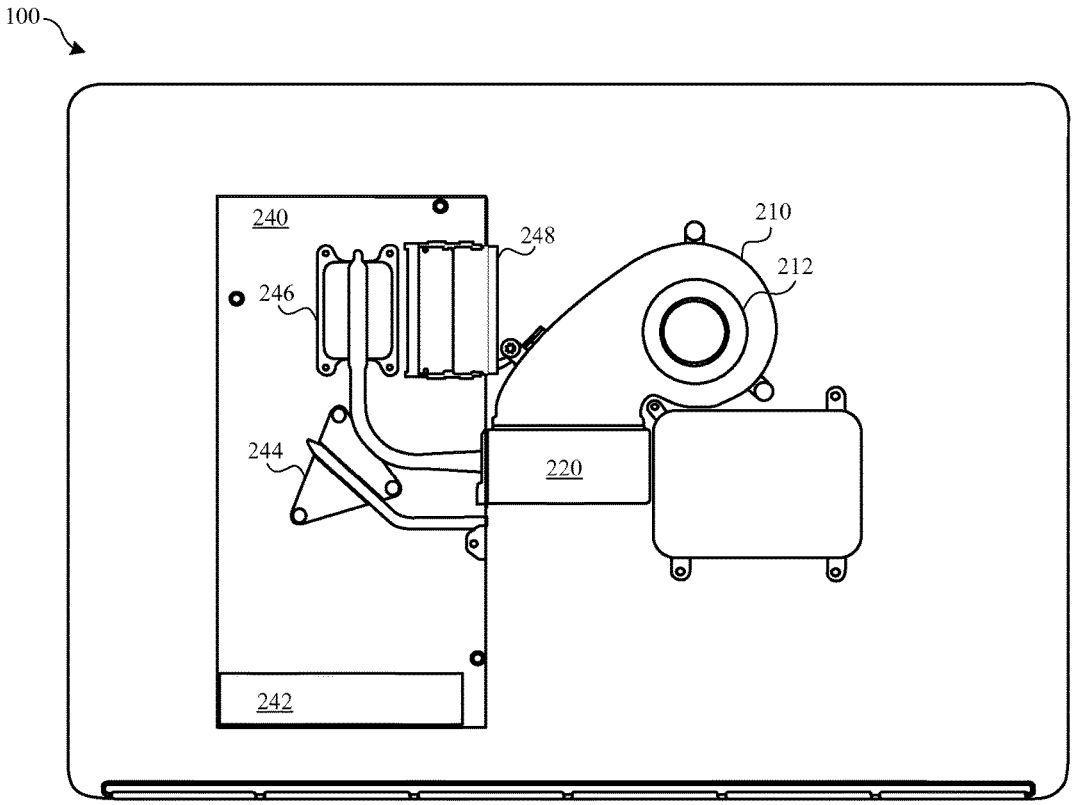
FIG. 2 shows an internal view of a computing device, with several other modules removed in order to show the placement of a fan, in accordance with some embodiments.

FIG. 2 shows an internal view of computing device 100, with the display and several other modules removed in order to show the placement of a fan 210. Fan 210 is a component that is responsible for drawing air into and expelling air out of computing device 100. In one embodiment, as illustrated in FIG. 2, fan 210 can be a centrifugal fan drawing air into fan inlet 212 and expelling air to outlet cooling vents through air conduit 220. As heat loading increases, fan 210 can operate at higher speeds to accelerate heated air more quickly to outlet cooling vents through air conduit 220, thereby increasing heat removal rates. In one embodiment, air flow generated by fan 210 can flow across main logic board 240, which includes inlet outlet port array 242, GPU 244, CPU 246 and random access memory modules 248. Subsequently, this air flow can be drawn into fan 210, through fan inlet 212.

Figure 3:
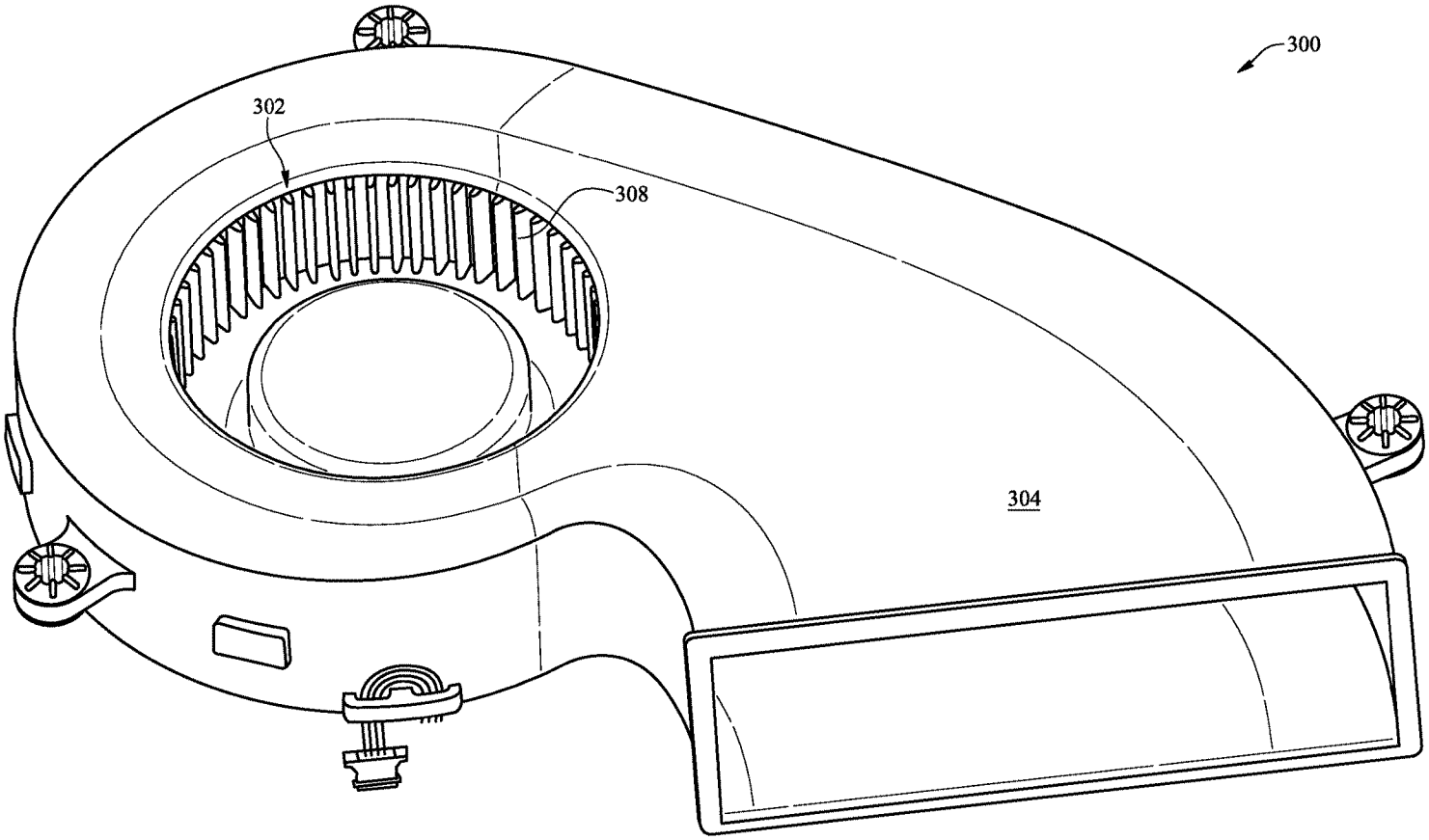
FIG. 3 (Related Art)
FIG. 3 shows an isometric view of a conventional fan from a primary inlet side.
Figure 4:
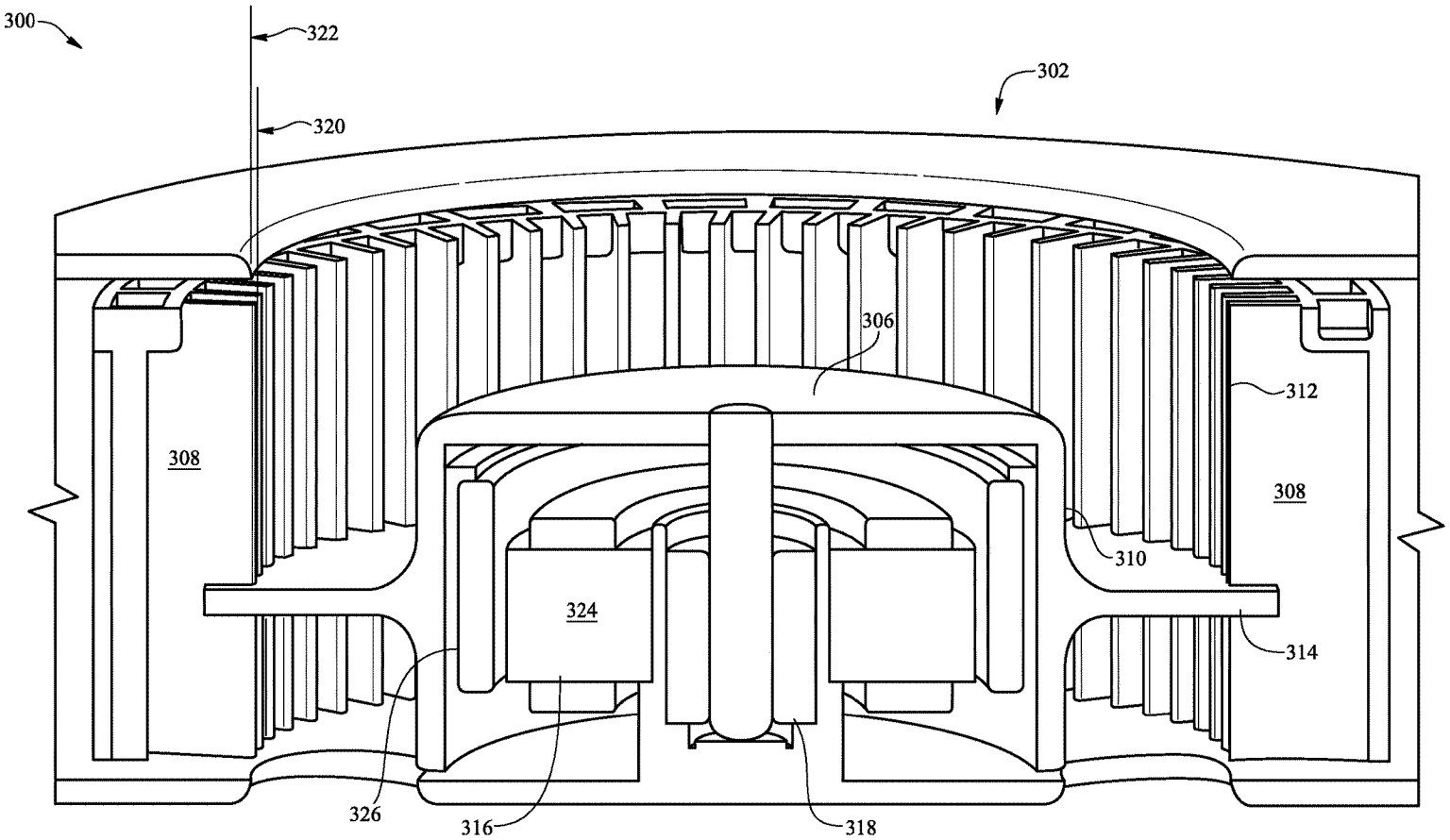
FIG. 4 (Related Art)
FIG. 4 shows a partial isometric cross-section view of the conventional fan from FIG. 3.

FIG. 3 shows an isometric view of a conventional fan 300. Fan 300 includes primary inlet 302 that is a circular opening in fan cover 304 through which impeller hub 306 and blades 308 can be seen. Fan 300 utilizes a cylindrical impeller hub 306 and blades 308 that have vertical (or straight) leading edges. FIG. 4 shows a cross-section view of conventional fan 300. In order to avoid impeding the entrance of air into the inlet 302, the leading edges 312 of blades 308 have a diameter 320 that is typically close to the same diameter 322 as the inlet 302 (i.e., primary inlet diameter). Conventional fan 300 has a cylindrical impeller hub 306 with substantially vertical sides 310 (with perhaps some draft angle to facilitate injection molding). Conventional fan 300 also has blades 308 with vertical leading edges 312. In fan 300, the blades are connected to cylindrical impeller hub 306 via an impeller disc 314. Motor 316 located within cylindrical impeller hub 306 drives fan 300. Note that the motor coils of brushless DC motor 316 are not shown in detail in FIG. 4. Bearing 318 provides for free rotation of the impeller. Fan 300 includes a 6-slot stator 324 and ferrite magnet 326.

Figure 5:
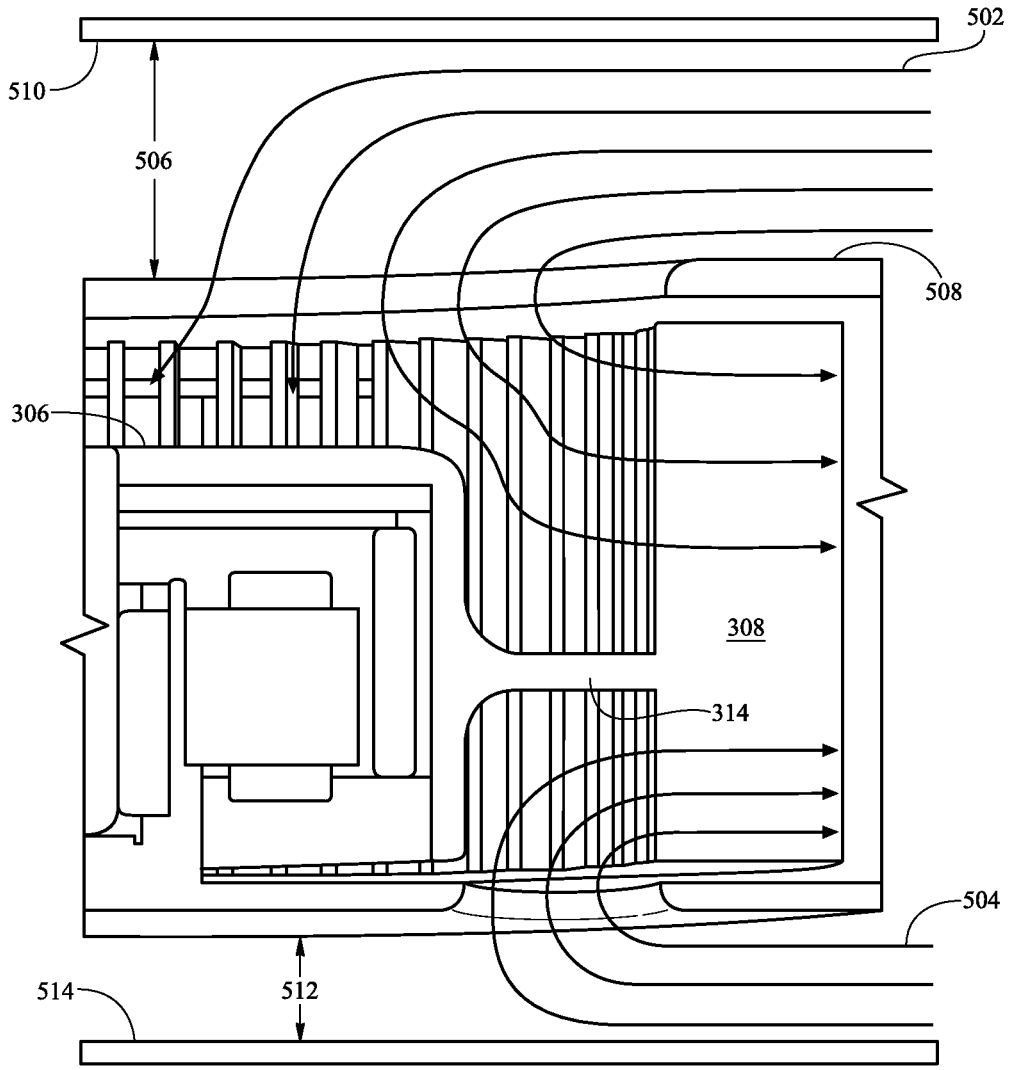
FIG. 5 (Related Art)
FIG. 5 shows an example of air flow pathlines entering the inlets of a conventional fan.

FIG. 5 shows example of air flow pathlines 502 and 504 entering the inlets of conventional fan 300 of FIGS. 3 and 4. As shown, cylindrical impeller hub 306 deflects some of the incoming air pathlines 502 and impedes them from reaching the leading edges of blades 308 at zones nearest to impeller disc 314. This results in sub-optimal utilization of the blade surface area of blades 308. FIG. 5 shows some of the air pathlines diverging from the inlet air moving toward the blades 308. Some of these divergent pathlines that impinge on the top of cylindrical impeller hub 306 do not reach blades 308 directly and are hence less effective in providing cooling. Additionally, the divergent pathlines can sometimes traverse the top of cylindrical impeller hub 306 and interfere with inlet air flow from the opposite side of the fan. There is a greater tendency for this inlet interference to occur when upper surface 510 (forming plenum gap 506 between the fan cover 508 and upper surface 510) and lower surface 514 (forming plenum gap 512 between fan cover 508 and lower surface 514) are not parallel, because incoming air is less impeded on one side of the fan versus another side.

To address these issues, embodiments described herein provide a fan with one or more of (1) progressively sloped fan blades, (2) a progressively sloped impeller hub, and (3) an inlet flow guidance feature. These embodiments are described below with reference to FIGS. 6-18.

(1) Progressively Sloped Fan Blade and (2) Progressively Sloped Impeller Hub

Figure 6:
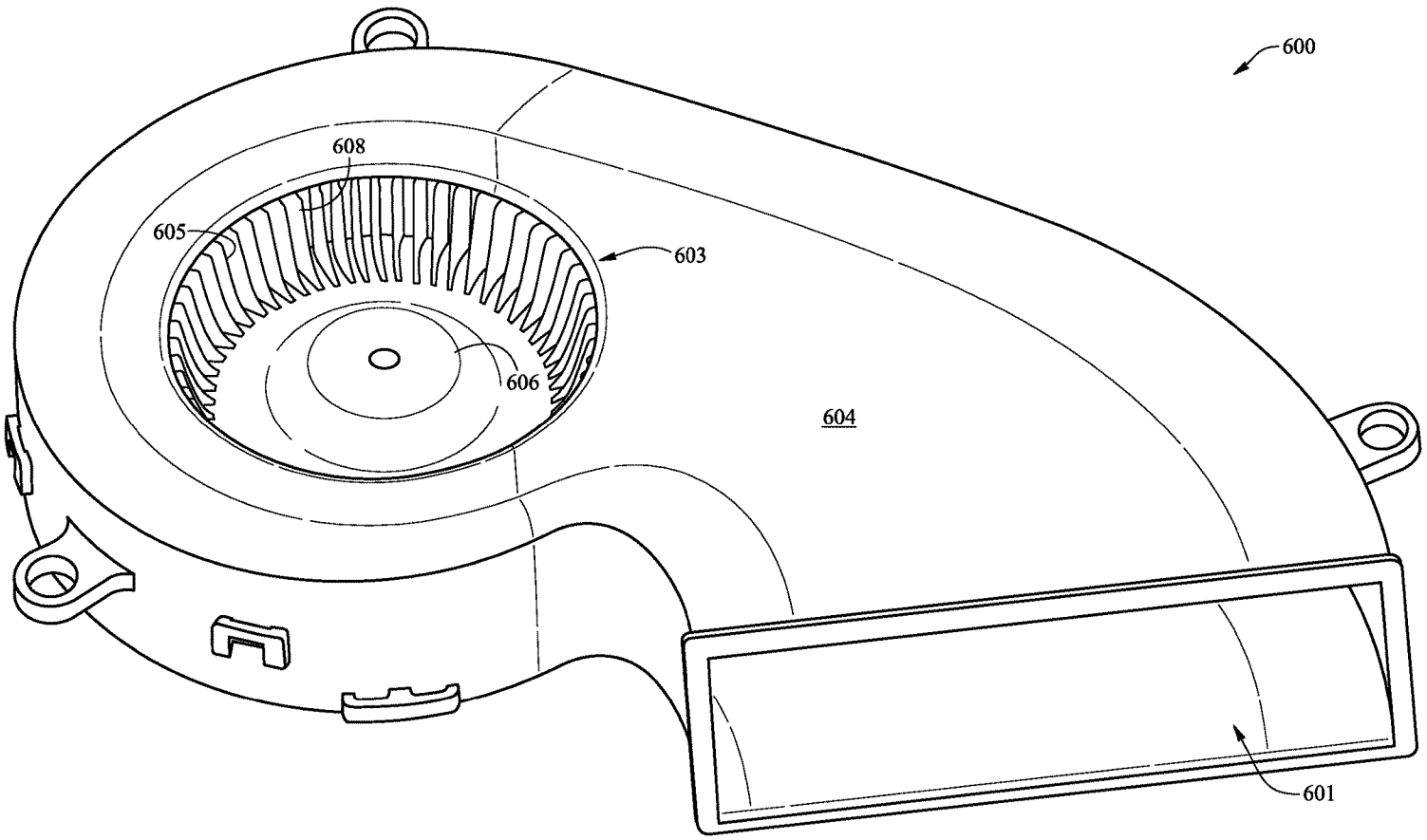
FIG. 6 shows an optimized fan that can use curved leading edges on the blades and a curved hub surface to optimize fan air flow performance without compromising acoustic performance, in accordance with some embodiments.

FIG. 6 shows an isometric view of fan 600 designed to optimize fan air flow performance without compromising acoustic performance, in accordance with described embodiments. FIG. 6 shows a primary inlet side of fan 600 that shows a primary inlet 603, which corresponds to an opening or set of openings within fan cover 604. Fan cover 604 can enclose portions of fan 600 therein. Exhaust 601 corresponds to where air is expelled from fan 600. Impeller hub 606 and blades 608 can be viewed through the primary inlet within fan cover 604. As shown, blades 608 have curved primary leading edges 605 and impeller hub 606 has a curved hub surface. This is in contrast to conventional fan 300, as shown in FIGS. 3-5, which utilizes a cylindrical hub and vertical blade leading edges.

Figure 7:
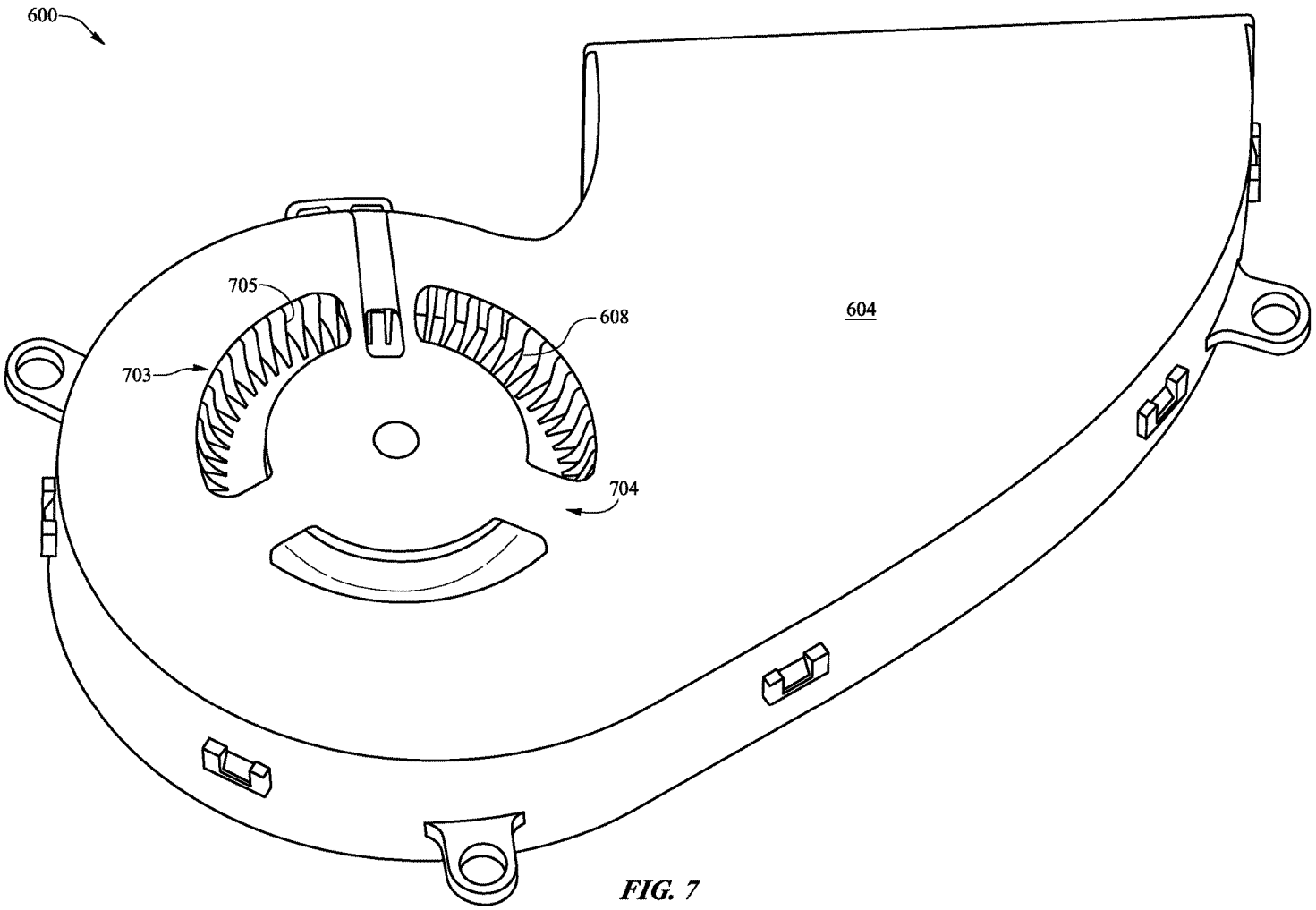
FIG. 7 shows the opposite, secondary-inlet side of the optimized fan from FIG. 6, in accordance with some embodiments.

FIG. 7 shows an isometric view of a secondary inlet side of fan 600. The secondary inlet 703 corresponds to a set of openings within fan cover 604 separated by support struts 704. In other embodiments, secondary inlet 703 is in the form of a single opening (not shown). In some embodiments, secondary inlet 703 is on an opposing side of fan cover 604 with respect to the primary inlet 603 shown in FIG. 6. In some embodiments, the primary inlet 603 is larger (has a larger diameter or area) than secondary inlet 703. In some embodiments, the secondary inlet 703 includes support struts 704 that surround and support the motor/impeller base. When assembled into a computer system, secondary inlet 703 can be located in a more air flow impeded part of the computer system than primary inlet 603. If secondary inlet 703 is smaller than primary inlet 603 and located in an air flow impeded area of the computer system, secondary inlet 703 can contribute less to an overall air flow performance compared to primary inlet 603.

As shown in FIG. 7, blades 608 can also have curved secondary leading edges 705 at secondary inlet 703 of cover 604. That is, blades 608 can include curved edges on leading edges above (primary leading edges 605) and below (secondary leading edges 705) an impeller disc of fan 600, as can be seen through both the primary 603 and secondary 703 inlets, as well as a curved hub 606 surface. This is in contrast to conventional fan 300 that utilizes a cylindrical hub having a substantially straight surface and vertical blade leading edges. Note that in some embodiments, fan 600 will include blades 608 with curved primary leading edges 605 at primary inlet 603 and not at the secondary inlet 703, or vice versa, and still provide benefits over conventional fan 300. Similarly, fan 600 can include blades 608 with curved leading edges 605 and/or 705 but not a curved impeller hub 606, or vice versa, and still provide benefits over conventional fan 300.

Figure 8:
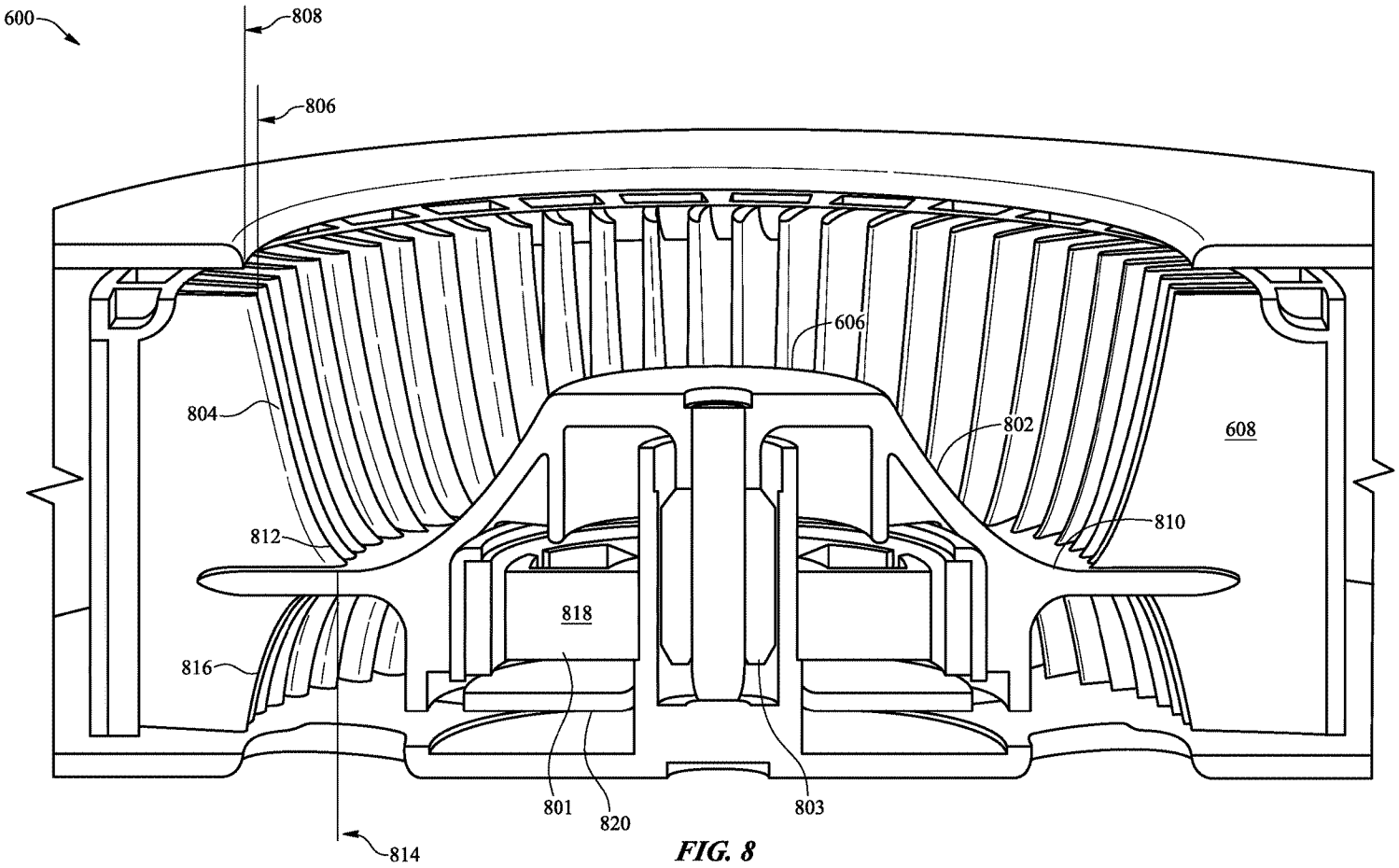
FIG. 8 shows a partial isometric cross-sectional view of the optimized fan from FIG. 6, in accordance with some embodiments.

FIG. 8 shows a cross-section view of fan 600 showing internal portions of fan 600, including motor 801, bearing 803, stator 818 and magnet 820. As shown, blades 608 can be attached to impeller disc 810 in accordance with a circumference of impeller disc 810. For example, leading edges 804 of blades 608 can be circularly arranged on impeller disc in accordance with a circumference of impeller disc 810. The circumference of impeller disc 810 associated with leading edges 804 can vary depending on design choice, with a larger circumference corresponding to leading edges 804 being farther away from the center of rotation of impeller disc 810 than a smaller circumference. In fan 600, the impeller hub 606 has curved surface 802 that has been shaped to reduce impedance of the inlet airflow. The leading edges 804 of blades 608 are progressively sloped such that the leading edge top diameter 806 is similar in size to the inlet opening diameter 808 (i.e., primary inlet diameter) to avoid impeding the inlet airflow. For example, curved surface 802 can have a non-linear shape with a diameter of the impeller hub progressively increasing starting at an end distal to impeller disc 810 and ending at an end proximal to impeller disc 810. In addition, leading edges 804 progressively encroach toward the center of rotation of impeller disc 810 as they approach impeller disc 810. That is, blades 608 are progressively curved toward the center of impeller disc 810 starting from ends of the blades distal from impeller disc 810 and ending proximal to impeller disc 810. This results in selectively adding blade surface area at base 812 of blades 608 to drive more air flow through fan 600 without appreciably increasing impedance of air entering the primary inlet that would be detrimental to air flow performance. The additional blade area near the base 812 of blades 608 where blades 608 are rooted to impeller disc 810 results in more centrifugal momentum imparted to the air surrounding this part of blades 608. This additional momentum results in more inlet air being drawn down to this lower part of the blade 608. The amount of sloping of leading edges 804 can be made more aggressive by reducing the vertex diameter 814 (i.e., the leading edge vertex diameter) shown in the FIG. 8 and/or adopting different types of mathematical functions defining the progressive curvature of leading edges 804. In addition, the shape of leading edges 816 of the lower portion of blades 608 below impeller disc 810 may be similarly customized.

Figure 9:
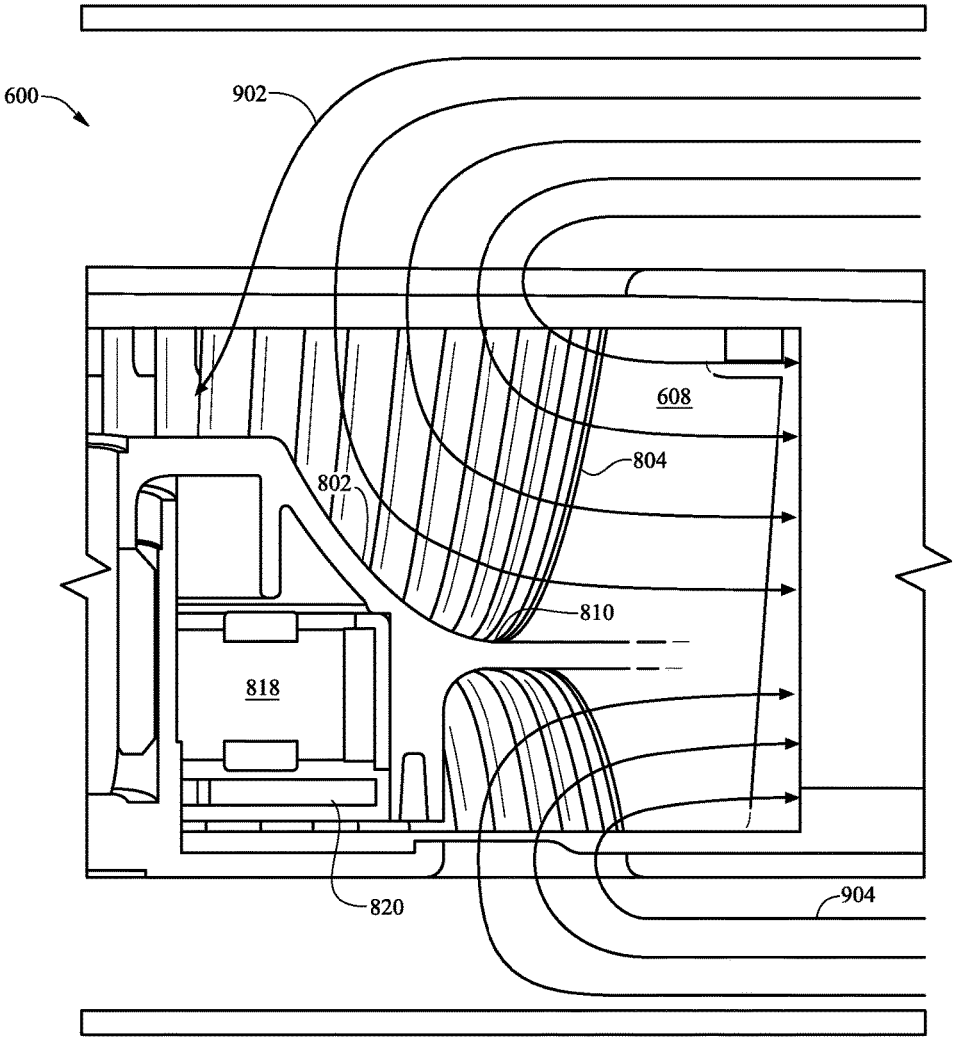
FIG. 9 shows an example of air flow pathlines entering the inlets of the optimized fan from FIG. 6, in accordance with some embodiments.

FIG. 9 shows an a partial cross-section view of fan 600, showing air flow pathlines 902 entering primary inlet and air flow pathlines 904 entering secondary inlet of fan 600. As shown, fewer air flow pathlines 902 diverge and impinge on the top of impeller hub 606 compared to conventional fan 300. That is, the curved surface 802 provides for a shallower corner at the top of impeller hub 606, thereby providing less impedance to incoming airflow. This provides the benefit of maximizing air flow performance by reducing air flow entrance losses. In addition, the increased radial blade length near impeller disc 810 distributes the air flow more evenly near impeller disc 810. It should be noted that the shaping of curved surface 802 of impeller hub 606 and/or the curved leading edges 804 of blades 608 can involve the use of a non-linear curvature function (such as a parabola) to produce a streamlined concave shape.

It should be noted that the typical motor design used in conventional fans, such as fan 300 described above with respect to FIGS. 3-5 include a 6-slot stator 324 and a ferrite magnet 326. This type of "lower-grade" motor design is less costly, but requires more space, thus requiring the large cylindrical impeller hub 306. In some embodiments, such as fan 600 shown in FIGS. 6-9, the fans described herein include more efficient motor designs that utilize a stator 818 having greater than 6 stator slots (e.g., 9 or 12 stator slots), a 3-phase brushless DC motor 801, and magnet 820 made of a rare earth magnet material such as neodymium-iron-boron to achieve a shorter height. The shorter heights of these more efficient types of motors enable more flexibility in the design and shaping of the impeller hub 606. Additional z-height reduction of the motor 801 can also be achieved by employing a sensor-less motor driver IC (integrated circuit) chip since there is no need of Hall-effect sensors that must be located near the motor magnet 820.

Figure 10:
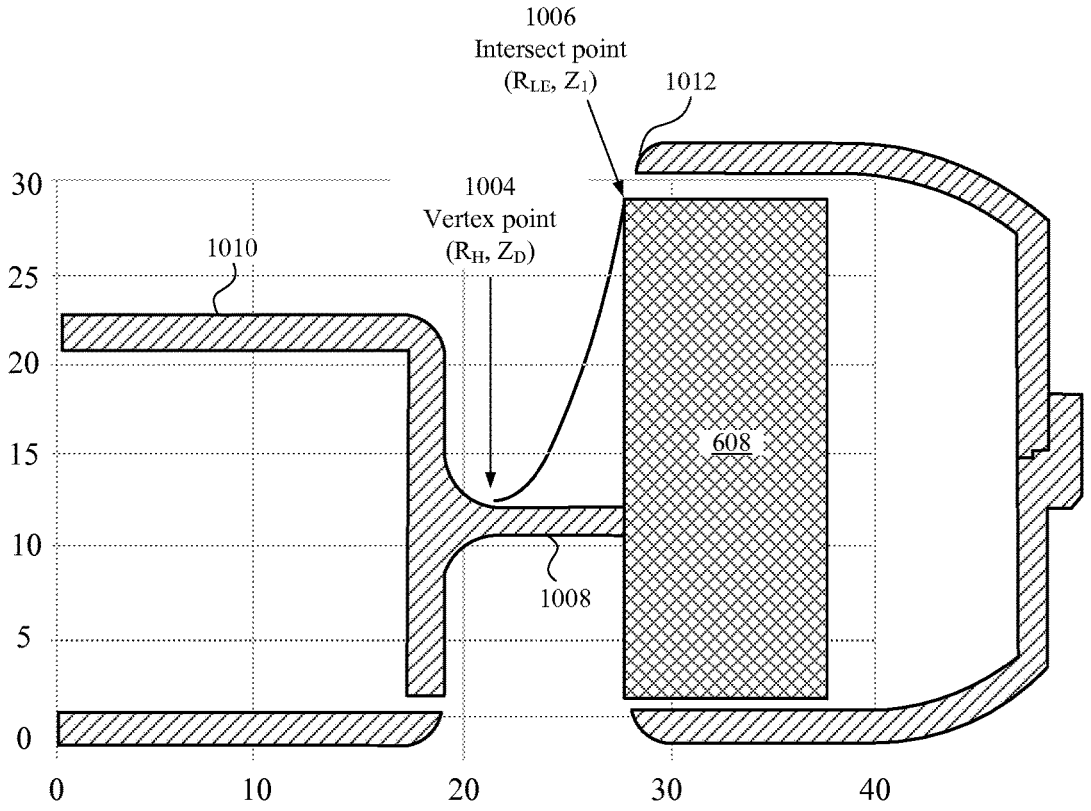
FIG. 10 illustrates one embodiment of progressive curvature for the impeller blade leading edges using a parabolic shaping function, in accordance with some embodiments.

As described above, the shape of curved surface 802 of impeller hub 606 and/or the leading edges 804 of blades 608 can be chosen based on a non-linear curvature. FIG. 10 illustrates one embodiment of a progressive curvature for impeller blade leading edges using a parabolic shaping function. The linear (straight or vertical) blade leading edges of a conventional fan can be replaced with blades 608 that have curved leading edges based on a parabolic function that can be constructed from a first location 1004 defining a vertex point and a second location 1006 defining a point where the parabola intersects the blades' 608 leading edges at a height and radius near inlet 1012. The first location 1004 can be located on or near the surface of the impeller disc 1008, or it can be moved inward onto the surface of hub 1010 if more aggressive sloping is desired. The second location 1006 is typically near the edge of inlet 1012 to avoid encroaching too far into the inlet opening (which causes impedance of inlet air flow), but other positions for the second location 1006 are also allowable to accommodate different plenum shapes or other factors affecting the air flow approaching the fan inlet. In some embodiments the curvature of blades 608 below impeller disc 1008 is determined using a fourth-order parabolic function that is less progressive and can be arrived at by using a power of 4 instead of a power of 2 shown in the curve of FIG. 10.

Following are equations showing how an optimal parabolic leading edge shape of FIG. 10 is based from a vertex form of the parabola equation:

$$z=a(x-x_v)^2+z_v$$

where $(x_v, z_v)$ correspond to vertex coordinates. The parabola intersects with a desired leading edge radius at the blade top $(R_{LE}, Z_1)$, corresponding to intersect point 1006, and with the hub-impeller disc intersection, corresponding to vertex point 1004. The following parameters can be defined:

$R_1$ is the inlet radius, r is the blade top reveal as seen through the inlet (i.e., portion encroaching into the inlet), $R_{LE}$ is $R_1-r$ (corresponds to the radius of leading edge at blade top), $Z_D$ is the z-height at the impeller disc top surface, $Z_1$ is the z-height at the blade top, and $R_H$ is the hub radius.

The vertex point 1004 is defined at the hub-impeller disc intersection, where $z_v$ is $Z_D$ and $x_v$ is $R_H$. Thus, $$z=a(x-R_H)^2+Z_D$$

Plugging these fan parameters into the parabola equation results in the following equation:

$$Z_1=a(R_{LE}-R_H)^2+Z_D$$

Solving for "a" provides tangent start at the hub-impeller disc intersection (vertex point 1004) at the top of the blade leading edge (intersect point 1006):

$$a=\frac{(Z_1-Z_D)}{(R_{LE}-R_H)^2}$$

Thus, using the parabola formula and fan parameters indicated in FIG. 10, an optimal parabolic leading edge shape can then be defined by the following equation:

$$z=\frac{(Z_1-Z_D)}{(R_{LE}-R_H)^2}(x-R_H)^2+Z_D$$

In another embodiment, a higher-order, even-numbered polynomial shaping function may be used. In other embodiments, any monotonically increasing function that is similar to a parabolic shaping function may be used. The linear (straight or vertical) leading edges of a conventional fan can be replaced with a parabolic function that can be constructed from a first location defining a vertex and a second location defining a point where the parabola intersects the blade leading edge at a height and radius near the inlet opening. The first location can be located on or near the surface of the impeller disc, or it can be moved inward onto the surface of the hub if more aggressive sloping is desired. The second location is typically near to the inlet edge to avoid encroaching too far into the inlet opening (which causes inlet impedance), but other positions for the second location are also allowable to accommodate different plenum shapes or other factors affecting the air flow approaching the fan inlet. The function shown in FIG. 10 can be used to generate the blade edge curvature above the disc shown in FIGS. 6-10. The curvature below the disc in those same figures uses a 4th-order polynomial function that is less progressive and can be arrived at by using a power of 4 instead of the power of 2 shown in FIG. 10.

Figure 11:
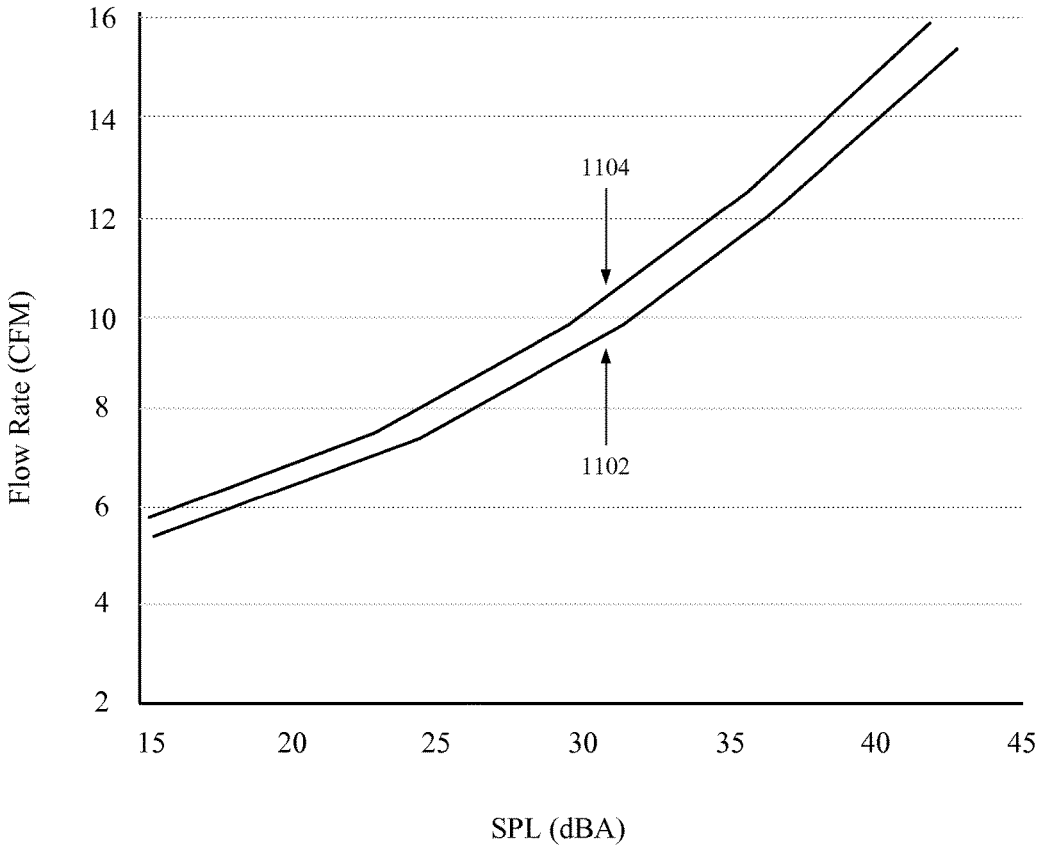
FIG. 11 shows test data for Flow Rate versus Sound Pressure Level, which demonstrate that an optimized fan with sloped leading blade edges can generate less acoustic noise than a conventional fan with vertical leading blade edges.

FIG. 11 shows a graph indicating test data for Flow Rate versus Sound Pressure Level of conventional fan 300 shown in FIGS. 3-5 versus a fan with a progressively sloped leading edge above the impeller disc only. In particular, line 1102 corresponds to data from conventional fan 300 and line 1104 corresponds to data from a fan with a progressively sloped leading edge above the impeller disc only. The graph demonstrates that an optimized fan with sloped leading blade edges can generate less acoustic noise than a conventional fan with vertical leading blade edges. The curvature of the leading edge can be similar to that shown in FIG. 10, with no leading edge curvature below the impeller disc and the hub shape remaining substantially cylindrical. This result illustrates that sloping the blades progressively by itself can increase the flow while simultaneously reducing acoustic noise. This allows the fan to achieve thermal goals at lower rotational fan speeds that are associated with reduced flow noise, providing a distinct competitive advantage with respect to the user experience.

There are multiple ways to implement embodiments described herein in addition to the configurations described above with respect to FIGS. 6-10. Also, the specific details of the impeller design, including parameters such as outer blade diameter, blade height, fan enclosure shape, inlet opening size, plenum gap, etc., should not be considered limitations to the scope of the embodiments described herein.

In one embodiment, a centrifugal fan can include fan blades with progressively decreasing leading edge diameter, where the leading edge diameter is measured with respect to the center of an impeller disc. In one embodiment, a rate of diameter change can be non-linear with respect to an axial direction. In one embodiment, a leading edge of the fan blades facing an impeller hub can be progressively curving towards a center of an impeller disc, where the impeller disc is centered on the impeller hub. In one embodiment, the rate of change of the impeller hub diameter can be characterized by a parabolic shape. In one embodiment, the parabola function can be defined by a vertex point on or near the surface of the impeller disc. In one embodiment, the parabola function can be defined by a vertex point on or near the surface of the impeller hub. In one embodiment, the parabola function can be defined by an intersect point at nearly the same diameter and axial height as an inlet opening edge.

In one embodiment, a fan can have two inlets: a primary inlet and a secondary inlet. In one embodiment, the progressively sloped leading edges of fan blades can be above an impeller disc (e.g., primary inlet side). In one embodiment, the progressively sloped leading edges of fan blades can be below an impeller disc (e.g., secondary inlet side). In one embodiment, the progressively sloped leading edges of fan blades can be both above and below an impeller disc (e.g., both primary inlet side and secondary inlet side).

In one embodiment, a fan can have an impeller hub that is shaped as a concavely sloped hub. In one embodiment, the sloped hub can be progressively curving towards fan blades, which are attached to the impeller disc in accordance with a circumference of the impeller disc, where the impeller disc is centered on the impeller hub. In one embodiment, the sloped hub can be characterized by a slope that is a parabolic shape. In one embodiment, the sloped hub can be characterized by a slope that is non-linear and concave. In one embodiment, the fan can include a low profile motor design with reduced height, where a stator slot count is greater than 6. In one embodiment, the fan can include a low profile motor design utilizing a sensor-less motor driver integrated circuit.

(3) Inlet Flow Guidance Feature

For fans of relatively cool electronic devices, care needs to be taken to ensure that the integration of the fan into the system promotes a smooth passage for air to flow into and out of the fan with as little impedance as possible. This allows air flow through the fan to be maximized while reducing potential sources of head or pressure loss and acoustic noise. In one embodiment, this reduction in impedance can be achieved by adding an inlet flow guidance feature to a region surrounding a fan's primary inlet to reduce entrance losses.

Figure 12:
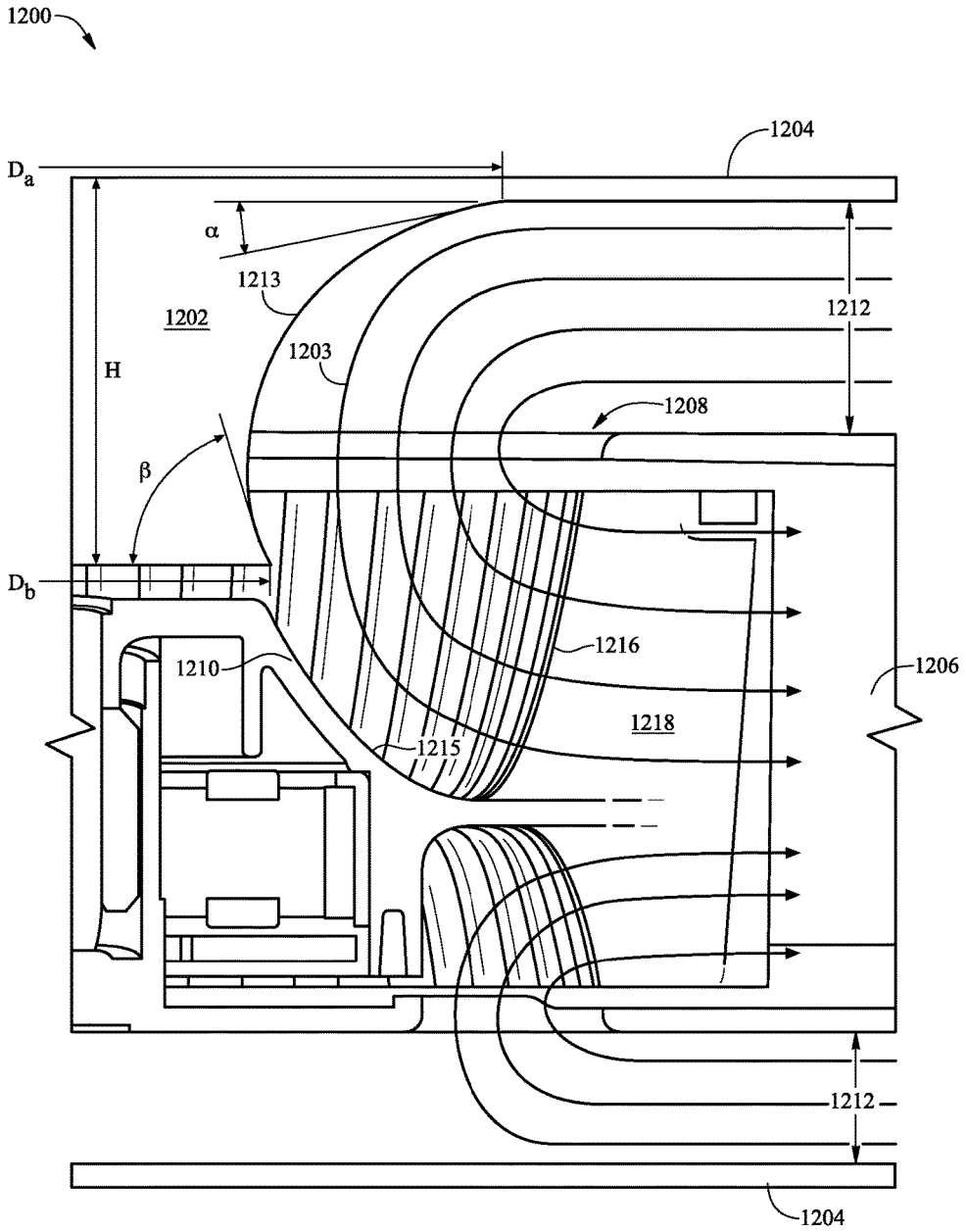
FIG. 12 shows that an inlet flow guidance feature can be added to the enclosure surrounding a fan's primary inlet to improve air flow through the fan, in accordance with some embodiments.

FIG. 12 shows fan assembly 1200, which includes inlet flow guidance feature 1202 to an enclosure 1204 surrounding the primary inlet 1208 of fan 1206 to improve air flow through fan 1206. Enclosure 1204 can correspond to any suitable type of enclosure. In some embodiments, enclosure 1204 corresponds to an outer enclosure for an electronic device. In some embodiments, enclosure 1204 corresponds to an enclosure of a subsystem that is situated within one or more enclosures. In some embodiments, inlet flow guidance feature 1202 is attached to or is part of enclosure 1204. Air flow passage through fan assembly 1200 is indicated by air flow pathlines 1203. Inlet flow guidance feature 1202 has a curved surface 1213 that is shaped to promote a smooth passage for air to flow into fan 1206 with as little impedance as possible. Inlet flow guidance feature 1202 can be a stationary part of system enclosure 1204 that effectively blocks air flow from entering the plenum 1212 directly above the impeller hub 1210. In some embodiments, inlet flow guidance feature 1202 has a curved surface 1213 that is positioned within and extends above primary inlet 1208 to guide air flow into primary inlet 1208. In one embodiment, curved surface 1213 cooperates with curved surface 1215 of impeller hub 1210 to provide an effective continuous curved surface that guides air flow entering primary inlet 1208 to leading edges 1216 of blades 1218.

Inlet flow guidance feature 1202 can be arranged such that inlet flow guidance feature 1202 is concentric with an axis of rotation of impeller hub 1210. In one embodiment, inlet flow guidance feature 1202 is attached to and configured to rotate with impeller hub 1210. Inlet flow guidance feature 1202 can be optimally shaped by adjusting its size and curvature to reduce or eliminate flow separation and inlet interference that is detrimental to fan air flow performance (i.e. reduce entrance losses). Inlet flow guidance feature 1202 can have an axisymmetric shape, or can have an irregular shape as required to make it more compatible with asymmetric plenum gaps 1212 surrounding fan 1206 (or other nearby sources of irregular system air flow impedance).

Inlet flow guidance feature 1202 shown in FIG. 12 includes several design parameters, including the angles $\alpha$ and $\beta$, the diameters $D_a$ and $D_b$, and the height H. These parameters can be adjusted to produce a more laminar steady inlet flow. Typically, angle $\alpha$ should be quite small or even tangent (e.g. $\alpha=0$). For progressively shaped impeller hubs 1210 that are curved like the one shown in FIG. 12, it is best design the shape of inlet flow guidance feature 1202 with an angle $\beta$ in the range of about $45° \leq \beta \leq 90°$, and for cylindrical hubs like the one shown in FIGS. 3-5, the best design can be expected to be in the range of about 45°≤β≤135°.

In some embodiments, substantially all of the air flowing into fan assembly 1200 should pass through the volume of space between the fan and the enclosure known as the plenum 1212. For thinner enclosures, this narrow plenum 1212 passage volume becomes correspondingly thinner. Assuming that the flow rates required for cooling the system are similar regardless of system enclosure 1204 thickness, a thinner enclosure 1204 requires the same amount of fluid to pass through a narrower plenum 1212 passage volume. This results in an increase in the average fluid velocity traveling in the radial direction towards the fan inlet 1208 through the plenum 1212 passage volume. For a system where the system enclosure 1204 is flat and parallel to the fan cover surface (as shown in FIG. 13) this average fluid velocity can be calculated according to the following equation:

$$\overline{v_{inlet,r}} = \frac{Q}{\pi D_{inlet} h}$$

where $\overline{v_{inlet,r}}$ is the average inlet air velocity in the radial direction (denoted by r) towards the rotational center of the impeller, Q is the bulk flow rate of air through the fan at the appropriate fan speed and operating point, $D_{inlet}$ is the circular inlet diameter of the centrifugal fan, and h is the height of the plenum passage (distance between fan and system enclosure).

Figure 13:
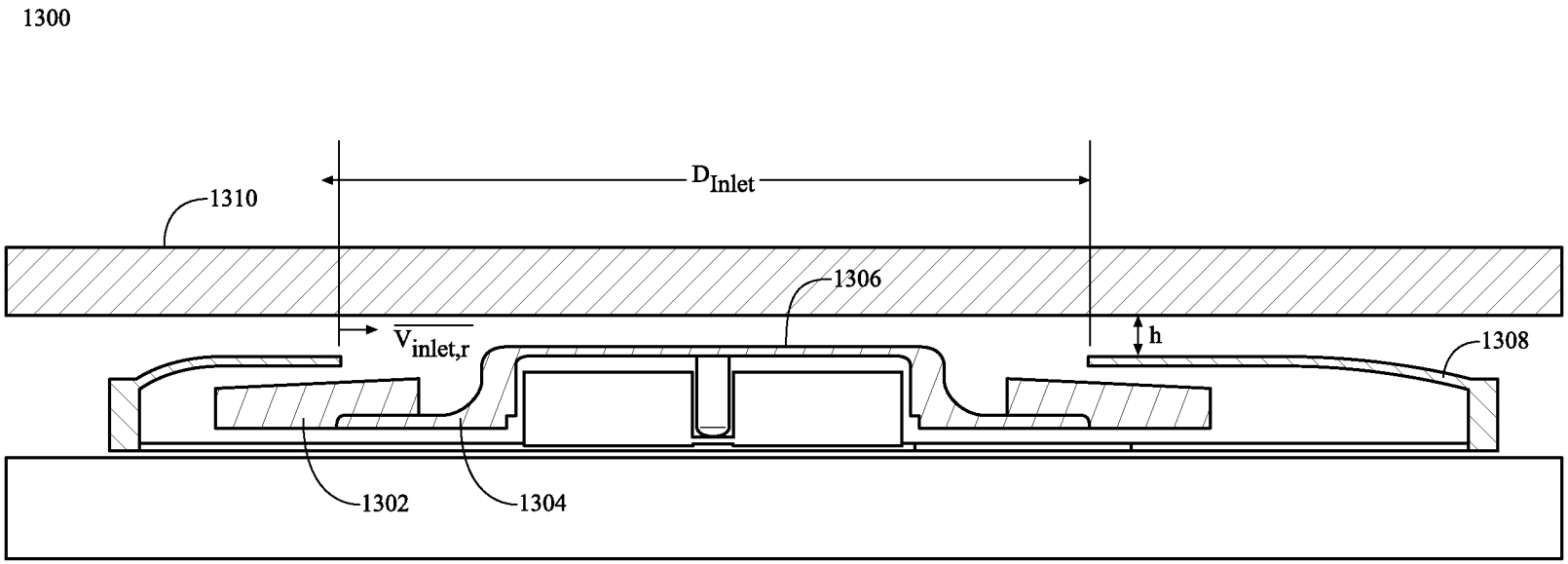
FIG. 13 shows a cross-section view of a fan with a constant inlet plenum height h and other critical parameters, in accordance with some embodiments.
Figure 14:
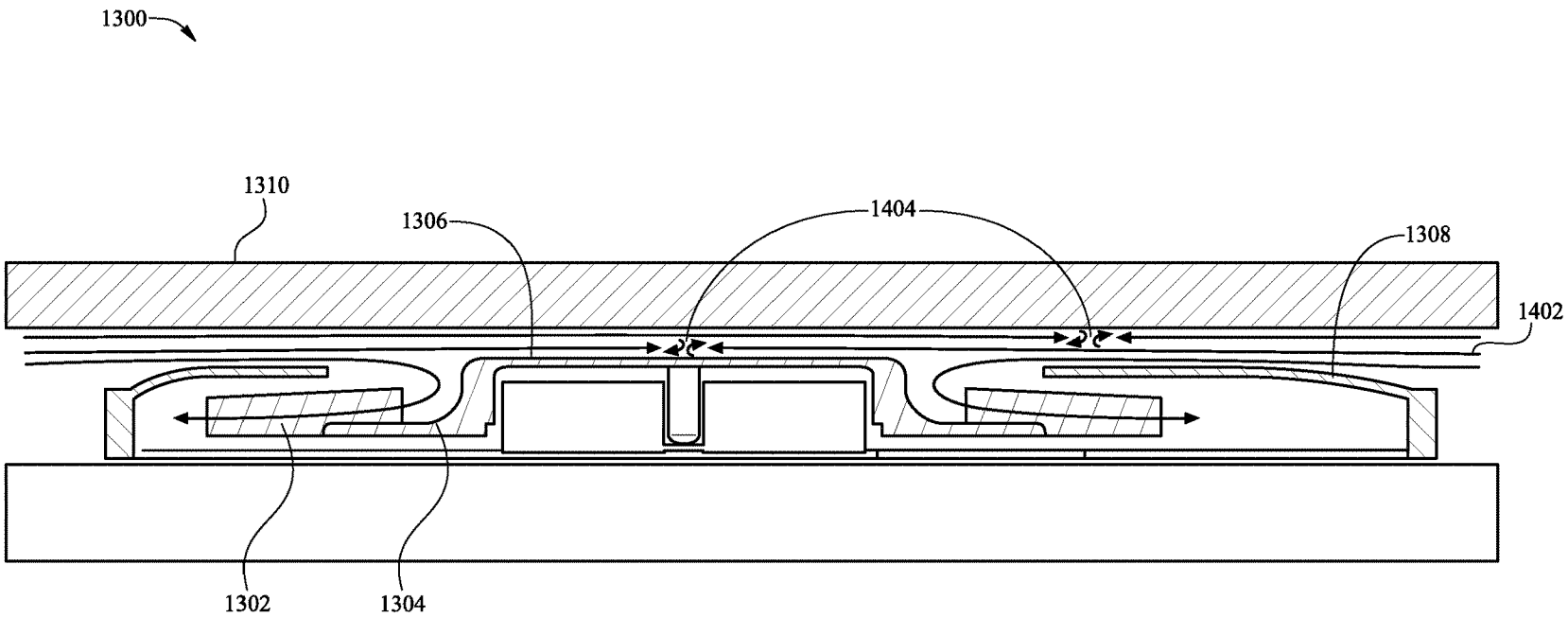
FIG. 14 shows a cross-section view of a fan where a portion of the inlet air flow can overshoot and flow over the top of the hub due to high flow velocity, and interfere with inlet air flow from the other side of the fan.

To illustrate advantages of an inlet flow guidance feature, FIGS. 13 and 14 show cross-section views of a fan assembly 1300 that does not include an inlet flow guidance feature and with a substantially constant plenum passage height h. Fan assembly 1300 includes fan blades 1302, impeller disc 1304, impeller hub 1306, fan cover 1308, and system enclosure 1310. FIG. 13 defines critical parameters that need to be considered when determining the radial component of the average fluid velocity moving towards a fan inlet. FIG. 14 shows air flow pathlines 1402 through fan assembly 1300 indicating where portions 1404 of the inlet air flow can have a high velocity, thereby separating from the mean air flow in through impeller blades 1302. The high velocity of this portion of the inlet air flow can further cause this portion 1404 of the inlet air flow to overshoot, flow over the top of impeller hub 1306, and interfere with incoming air flow from the other side of the fan.

From the above equation, if $D_{inlet}$ and Q are held constant, then $\overline{v_{inlet,r}}$ increases linearly with a decrease in h. This means that air velocity towards the fan inlet can be increased due to a slim computer enclosure. When air velocity towards the fan inlet is increased due to a slim computer enclosure, it can be more challenging to efficiently turn this air into the fan inlet and, subsequently, the impeller. This is especially true for the higher operating fan speeds, which result in a higher flow rate (Q), and therefore, higher inlet velocities. An inlet flow with high radial velocities can result in some of the inlet flow overshooting the fan inlet, and flowing over the impeller hub 1306, as shown in FIG. 14. This overshooting flow can intersect and mix with air flowing radially towards the inlet from the other side. In certain cases, there may be an imbalance in inlet flow velocity from one side of the fan inlet to the other. If this imbalance is significant enough, then the inlet flow from the stronger side can overshoot the fan inlet completely and serve to impede incoming air from the other side of the fan. This can result in reduced air flow performance and potentially increased air flow noise. The intersection of inlet flow between streams from opposite sides of the fan inlet can result in mixing and therefore increased shear, potentially generating air flow noise.

Figure 15:
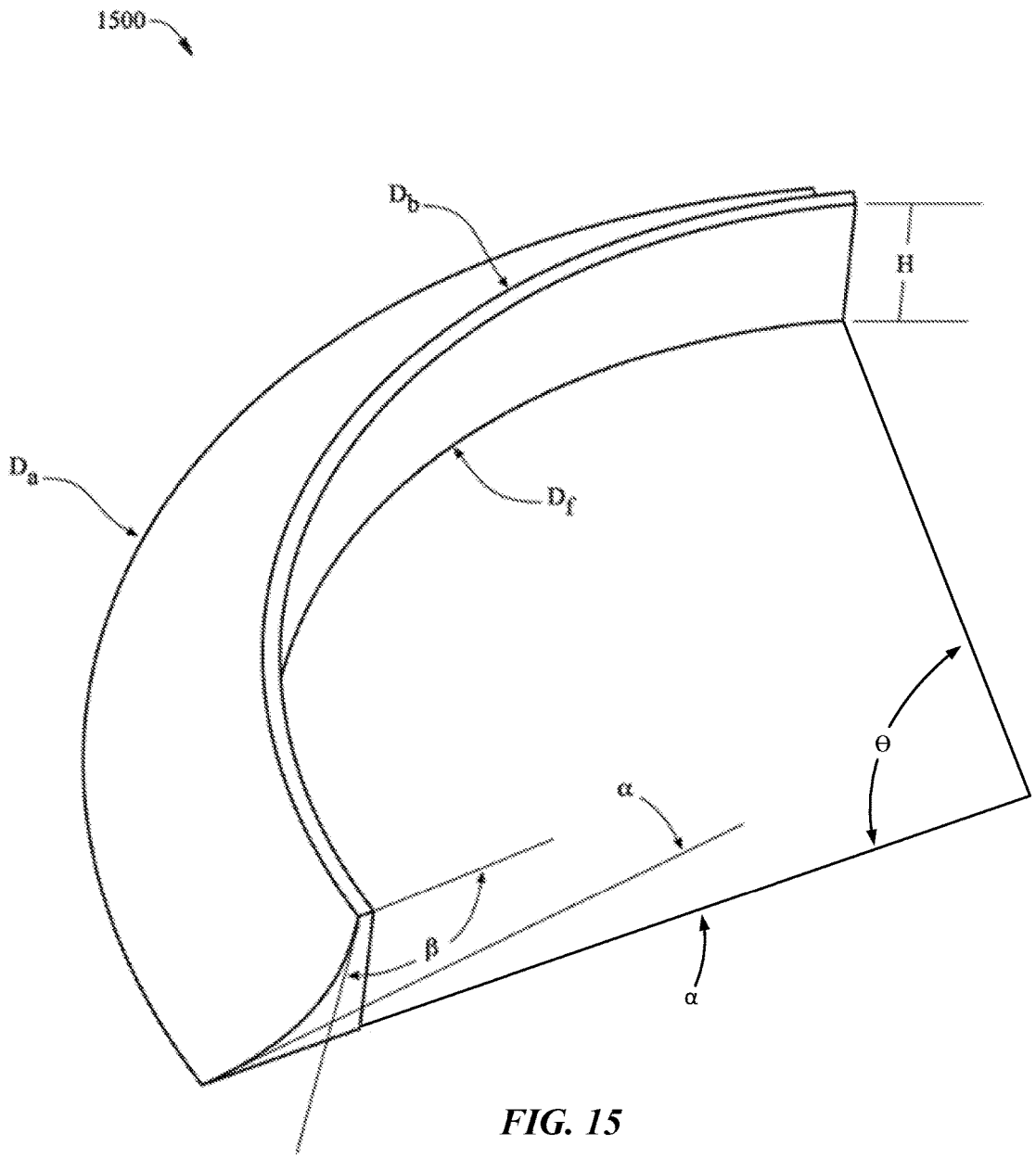
FIG. 15 shows key geometric parameters for an inlet flow guidance feature, in accordance with some embodiments.

FIG. 15 shows a partial view of inlet flow guidance feature 1500 indicating geometric parameters of an inlet flow guidance feature, in accordance with some embodiments. Inlet flow guidance feature 1500 can have ring shape or disc shape. The ring or disc shape can be in accordance with a circular shaped fan inlet. As shown in FIG. 15, key parameters can include:

α is the initial flow guidance angle at an inlet of the flow guidance feature,

β is the angle of flow guidance at an outlet of the flow guidance feature,

θ is the subtended angle of the flow guidance feature. For a full disc or ring, this angle is equal to a full 360°, H is the height of the flow guidance feature from a feature inlet to a feature outlet (In asymmetric guidance features, H can be a function of θ), $D_a$ is the diameter of the flow guidance feature where it meets the surface of the system enclosure, $D_b$ is the diameter of the flow guidance feature near the impeller hub surface, and $D_f$ is the internal diameter of the flow guidance feature. (For a disc, this value will be zero—i.e., no internal diameter—and for a ring, this value will be non-zero).

In some embodiments, Da is larger than Db. Portions of inlet flow guidance feature 1500 at $D_a$ can correspond to first edge 1502 and portions of inlet flow guidance feature 1500 at $D_b$ can correspond to second edge 1504. In some embodiments, first edge 1502 is proximate to or meets the surface of the system enclosure (e.g., 1204) and second edge 1504 is proximate to or near to the impeller hub (e.g., 1210). In some embodiments, curved surface 1213 continuously connects edges 1502 and 1504.

Figure 16:
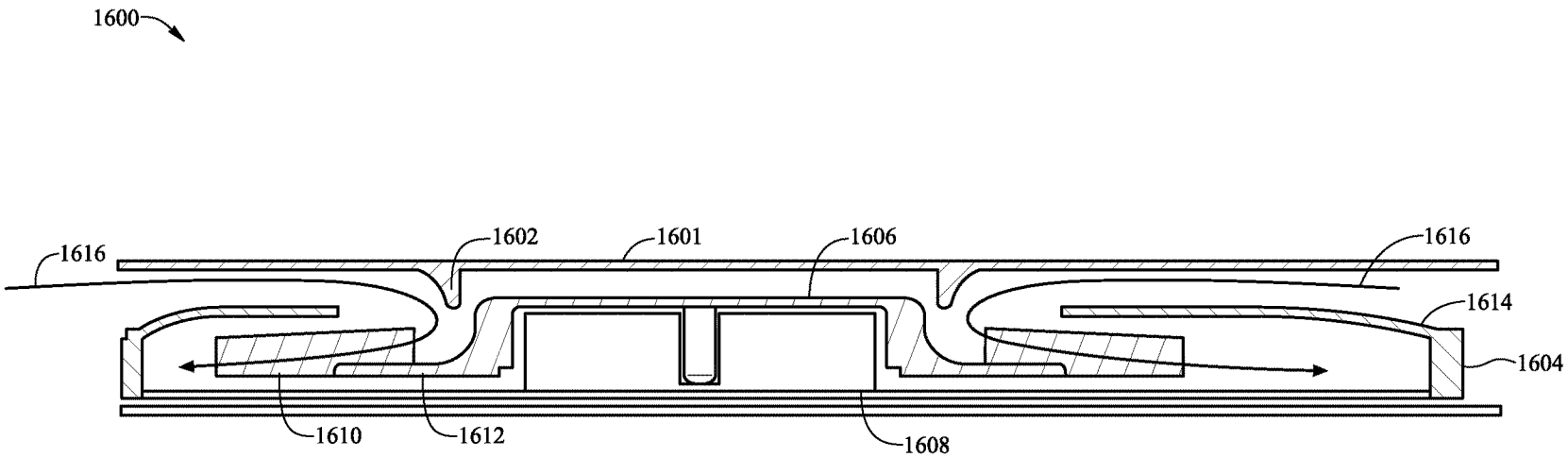
FIG. 16 shows a cross-section view of an inlet flow guidance ring feature intended for use in a portable computing system or other system with minimal clearance between the top of the fan hub and the system cover, in accordance with some embodiments.

FIG. 16 shows a cross-section view of fan assembly 1600 with an inlet flow guidance feature 1602, in accordance with some embodiments. Fan assembly 1600 includes fan 1604, which includes impeller hub 1606, motor/bearing assembly 1608, fan blade 1610, impeller disc 1612, and fan cover 1614. Fan 1604 is assembled within enclosure 1601, which can correspond to an enclosure for a computing system. Fan assembly 1600 is intended for use in a system with minimal clearance between the top of the fan hub and the system enclosure, such as a portable computing system or other slim consumer electronic device. Inlet flow guidance feature 1602 can be in the form of a ring that follows an outer perimeter of impeller hub 1606. Pathlines 1616 indicate mean airflow direction through fan assembly 1600.

In one embodiment, inlet flow guidance feature 1602 can be a specifically shaped ring ($D_f$>0) that is attached to the inside of enclosure 1601, concentric with the impeller center of rotation, as shown in FIG. 16. As shown, inlet flow guidance feature 1602 deflects inlet air flow away from the computer enclosure and directly into an impeller inlet zone of fan 1604. This redirects the momentum of the inlet air flow into the intended direction and away from impingement with the rotating impeller hub 1606 and away from interaction with inlet air flowing from the other side of the fan plenum. The curved part of the inlet flow guidance feature 1602 that is intended to be guiding the inlet air flow can be shaped with a simple circular radius, a conical surface/chamfer, a cylindrical surface, a non-circular spline, or a combination of any number of these.

In one embodiment, the inlet flow guidance feature can be implemented in a system with sufficient clearance between the impeller hub and the system cover to allow the inlet flow guidance feature to be a full disc rather than a ring ($D_f$=0). This allows the diameter of the lower part of the inlet flow guidance feature ($D_b$) to be as close as possible to the diameter of the top of the fan hub ($D_{hub}$), and in this way can allow a smooth transition from the stationary inlet flow guidance feature to the rotating impeller. This is similar to inlet flow guidance feature 1202 in FIG. 12. This can help to minimize entrance losses of the flow as it makes the turn from the plenum passages into the impeller blades.

Figure 17:
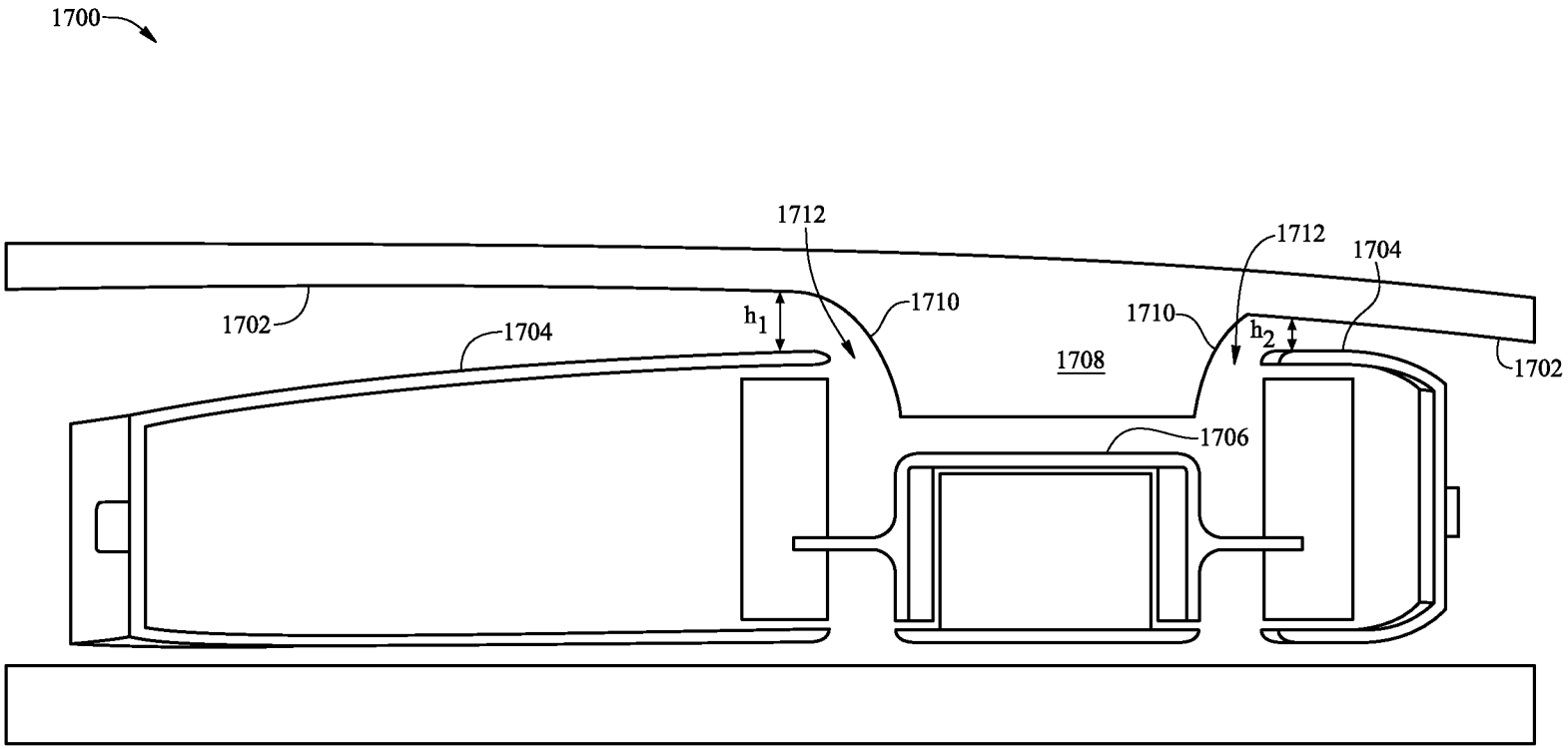
FIG. 17 shows a cross-section view of an inlet flow guidance ring feature that is implemented in a system enclosure with uneven primary inlet plenum height ($h_1 \neq h_2$), in accordance with some embodiments.

In one embodiment, the inlet flow guidance feature can be implemented in a system enclosure with uneven primary inlet plenum height. An example of this is shown in FIG. 17 showing a cross-section view of fan assembly 1700, where the primary inlet 1712 plenum heights between inner surface of enclosure 1702 and top surface of fan cover 1704 are uneven ($h_1 \neq h_2$). That is, a first distance (corresponding to $h_1$) between a portion of fan cover 1704 and enclosure 1702 is different than a second distance (corresponding to $h_2$) between another portion of fan cover 1704 and enclosure 1702. As shown, inlet flow guidance feature 1708 has curved surface 1710 arranged relative to primary inlet 1712 to guide air flow through primary inlet 1712 and around sides of fan impeller hub 1706. In this instance the clearance between fan impeller hub 1706 and enclosure 1702 is sufficient to allow the inlet flow guidance feature 1708 to be a full disc rather than a ring. Also, inlet flow guidance feature 1708 is integrated into the system enclosure 1702.

In one embodiment, the inlet flow guidance feature would not subtend an entire circle of the fan inlet ($\theta$<360°). In this case, the inlet flow guidance feature could be an arc of material rather than a full ring. This can be implemented in systems where there is a consistent tendency for the inlet air flow to overshoot the impeller hub in one particular location across a range of fan operating speeds. In such a case, a full ring of inlet flow guidance feature may not be necessary and the unnecessary segment of the ring would otherwise add impedance to the incoming air stream and thereby reduce the flow rate through the fan. The arced guide would be accurately positioned in the system to be concentric with the impeller center of rotation, but angled/clocked to provide flow guidance only where it is desired.

In one embodiment, where sufficient clearance permits the guidance feature to occupy space between the top of the impeller hub and the system cover, a full disc ($D_f$=0) of material covering a full 360° may not be necessary or desired. In this case, the inlet flow guidance feature could only occupy the fan inlet zone in the area where inlet overshoot is found to be most likely. This implementation can be such that the inlet flow guidance feature does not occupy space where it is not needed, so as to minimize unnecessary impedance to the inlet air flow.

In one embodiment, the inlet flow guidance feature can still be a full ring, but the cross-section of this ring can vary across its angular span. For example, at one angular location the inlet flow guidance feature can have a circular radius cross-section for its guide surfaces and at another angular location this cross-section can be conical or chamfered. Alternatively the height of the inlet flow guidance feature can vary with angular location to provide less guidance and impedance where guidance is not needed.

In one embodiment, the inlet flow guidance feature can be integrated into the computer enclosure. The location of this feature can be concentric with the impeller axis of rotation.

In one embodiment, an impeller hub top diameter can be equal to or smaller than a diameter $D_b$ of an inlet flow guidance feature. In one embodiment, an inlet flow guidance feature can be attached to a computer enclosure. In one embodiment, an inlet flow guidance feature can be rotating and attached to/integrated with an impeller hub. In one embodiment, an inlet flow guidance feature can be irregular in shape. In one embodiment, a gap between a fan and a surrounding computer system can be irregular or asymmetric. In one embodiment, an inlet flow guidance feature can be axisymmetric. In one embodiment, an inlet flow guidance feature angle $\beta$ can be in the range $45° \leq \beta \leq 135°$. In one embodiment, an inlet flow guidance feature angle $\alpha$ can be in the range $0° \leq \alpha \leq 45°$. In one embodiment, a sloped hub shape and an inlet flow guidance feature shape can be similar with respect to a fan cover, which defines a "mirror plane".

For any of the above embodiments, the inlet flow guidance feature can either be a separate part that is affixed to the system opposite the fan impeller hub, or the inlet flow guidance feature can be integrated into the system itself.

The various aspects, embodiments, implementations or features of the described embodiments can be used separately or in any combination. Each of the disclosed embodiments can be used as a separate, individual means for optimizing fan air flow performance by reducing entrance losses at the fan inlet without compromising acoustic performance. At the same time, each of the disclosed embodiments can also be used in combination to achieve greater optimization. As an example, there can be three embodiments for optimizing fan air flow performance without compromising acoustic performance. The three embodiments are: (1) progressively sloped fan blade leading edges, (2) concavely sloped impeller hub, and (3) incorporation of an inlet flow guidance feature. Accordingly, optimization can be achieved by solely using progressively sloped fan blade leading edges, or by solely using concavely sloped impeller hub, or by solely incorporating an inlet flow guidance feature. For example, the graph of FIG. 11 shows that flow rate and acoustic optimization can be achieved by solely using sloped fan blades, since the impeller hub used is not sloped. FIGS. 6-8 show that optimization can be achieved by using a combination of embodiments (e.g., both sloped fan blade and sloped impeller hub).

Figure 18A:
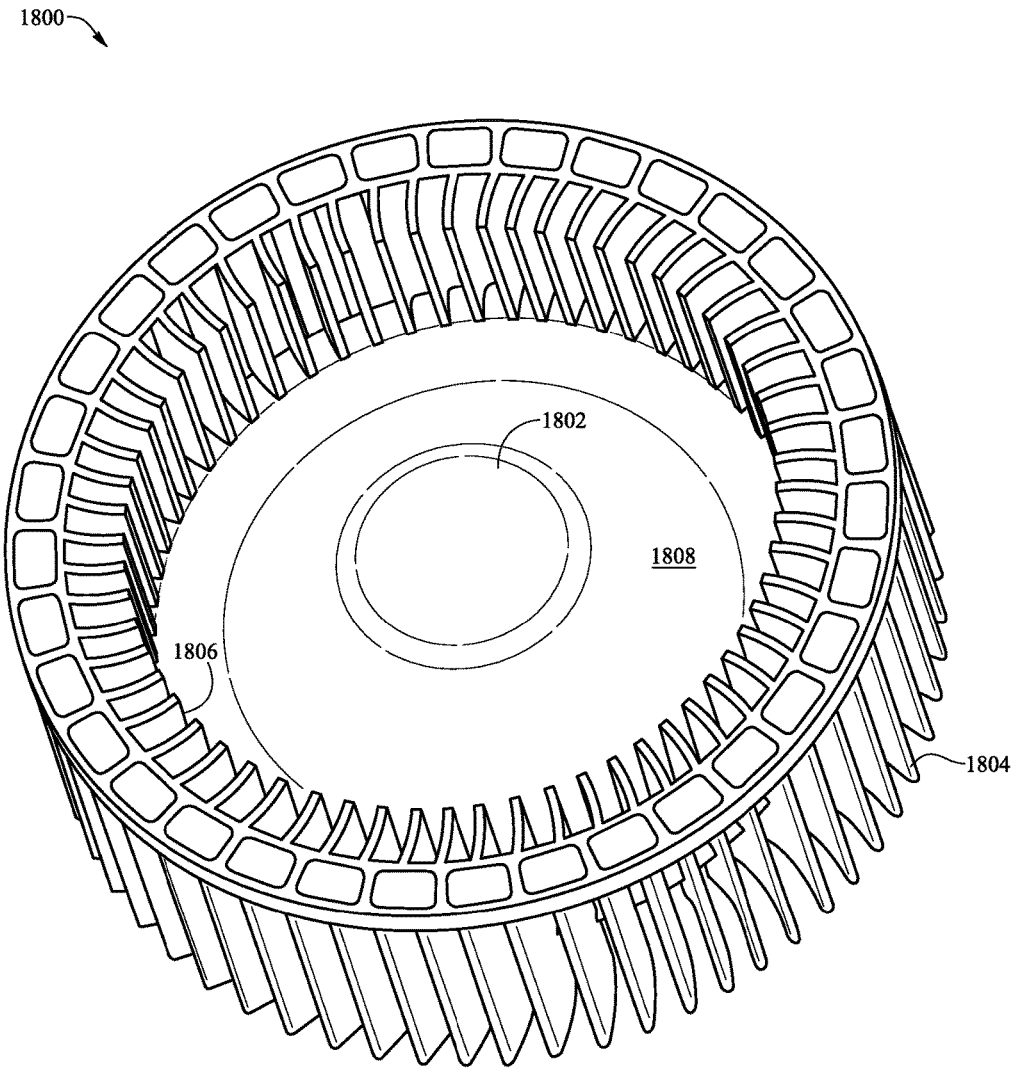
FIG. 18A shows an optimized fan impeller that can use a curved hub surface and straight leading edges on the blades to optimize fan air flow performance without compromising acoustic performance, in accordance with some example embodiments.
Figure 18B:
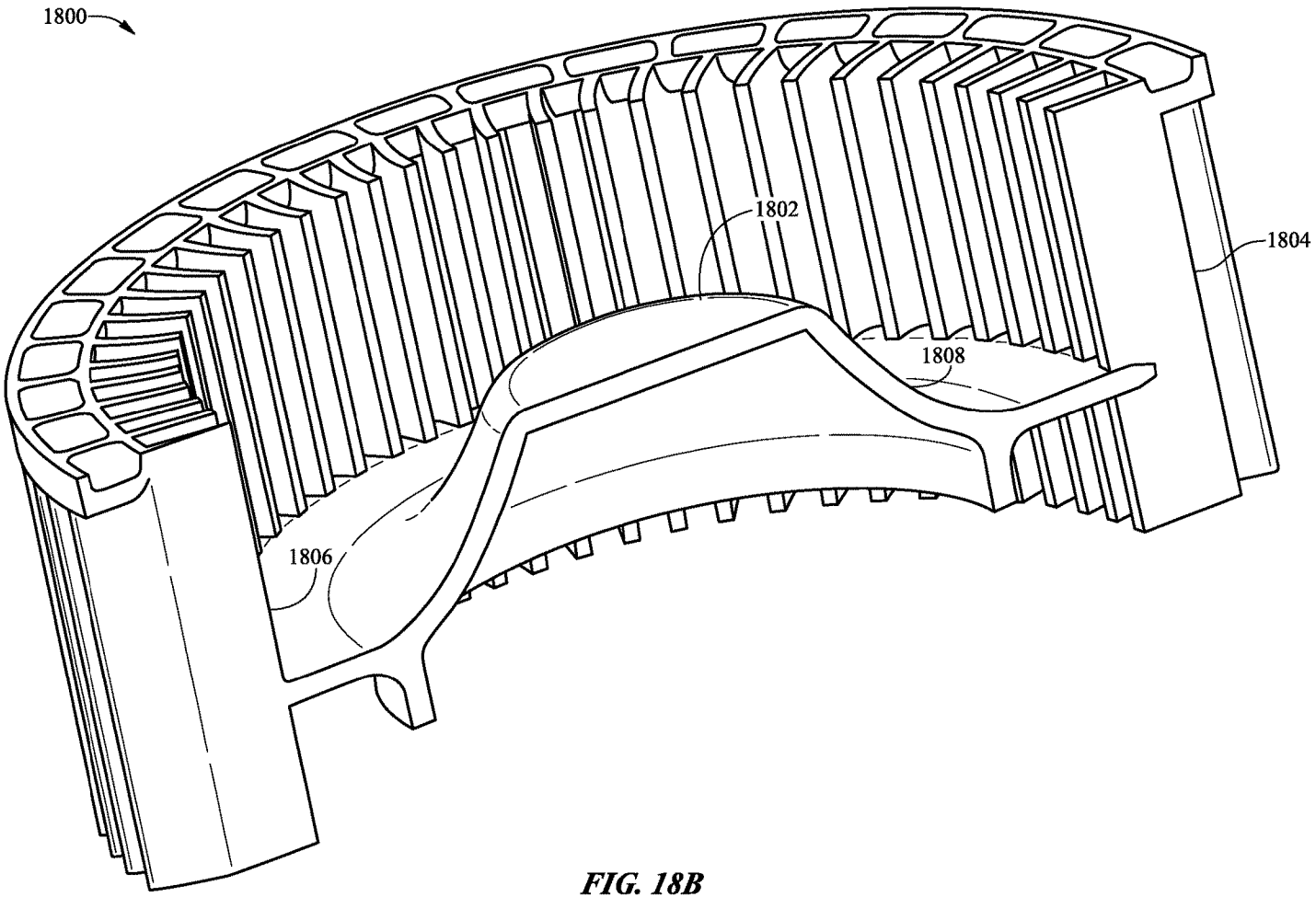
FIG. 18B shows a partial isometric cross-sectional view of the optimized fan impeller from FIG. 18A, in accordance with some embodiments.

FIGS. 18A and 18B show isometric views of a portion of fan 1800, which includes impeller hub 1802 and fan blades 1804, in accordance with some embodiments. As shown, impeller hub 1802 has a progressively sloped surface 1808 while leading edges 1806 of fan blades 1804 are not contoured. Although leading edges 1806 are not sloped or contoured, the progressively sloped surface 1808 of impeller hub 1802 can provide some of improved air flow and/or acoustic benefits described above, indicating that optimization can also be achieved by solely using a sloped impeller hub 1802.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A fan optimized for air flow performance within a computing device, the fan comprising:

an impeller hub;

an impeller disc attached to the impeller hub, wherein the impeller disc is centered with respect the impeller hub, and wherein the impeller disc comprises a first surface and a second surface opposite the first surface; and a plurality of fan blades attached to the impeller disc, wherein each fan blade of the plurality of fan blades comprises a first portion extending from the first surface of the impeller disc and a second portion extending from the second surface of the impeller disc, wherein at least a portion of a leading edge facing the impeller hub of the first portion of each fan blade and at least a portion of a leading edge facing the impeller hub of the second portion of each fan blade of the plurality of fan blades is concavely curved toward a center of the impeller disc, and wherein the impeller hub has a concavely sloped surface that is progressively curved toward the plurality of fan blades.

2. The fan of claim 1, wherein the curved leading edges are characterized by a progressively decreasing leading edge diameter, wherein the leading edge diameter is measured with respect to the center of the impeller disc, wherein a rate of change of the leading edge diameter is non-linear with respect to an axial height of the plurality of blades.

3. The fan of claim 1, wherein the plurality of blades are progressively curved toward the center of the impeller disc starting from ends of the blades distal from the impeller disc and ending proximal to the impeller disc.

4. The fan of claim 1, further comprising:

an inlet flow guidance feature positioned proximate an inlet of the fan, the inlet flow guidance feature having a curved surface that is configured to promote a smooth passage of air flow into the inlet.

5. A fan optimized for air flow performance within a computing device, the fan comprising:

an impeller hub;

an impeller disc attached to the impeller hub, wherein the impeller disc is centered with respect to the impeller hub; and a plurality of fan blades attached to the impeller disc in accordance with a circumference of the impeller disc, wherein at least a portion of a leading edge of each fan blade facing the impeller hub is concavely curved toward a center of the impeller disc, and wherein the impeller hub has a concavely sloped surface that is progressively curved toward the plurality of fan blades.

6. The fan of claim 5, wherein the concavely sloped surface is characterized as having a slope with a non-linear shape.

7. The fan of claim 5, wherein fan includes a primary inlet having an inlet flow guidance feature that modifies air flow within a plenum zone above the impeller hub.

8. The fan of claim 5, wherein the concavely sloped surface is non-linear and a diameter of the impeller hub progressively increases starting at an end distal to the impeller disc and ending at an end proximal to the impeller disc.

9. The fan of claim 5, further comprising:

an inlet flow guidance feature positioned proximate an inlet of the fan, the flow guidance feature configured to promote a smooth passage of air flow into the inlet.

10. A cooling system that is optimized for air flow performance within a computing device, the cooling system comprising:

a fan comprising an impeller hub and an inlet;

an impeller disc attached to the impeller hub;

a plurality of fan blades attached to the impeller disc in accordance with a circumference of the impeller disc, wherein at least a portion of a leading edge of each fan blade facing the impeller hub is concavely curved toward a center of the impeller disc, and wherein the impeller hub has a concavely sloped surface that is progressively curved toward the plurality of fan blades; and an inlet flow guidance feature positioned proximate the impeller hub and the inlet, the inlet flow guidance feature having a curved surface positioned relative to the inlet that promotes a smooth passage of air flow into the inlet.

11. The cooling system of claim 10, wherein the inlet flow guidance feature is concentric with an axis of rotation of the impeller hub.

12. The cooling system of claim 10, wherein the inlet flow guidance feature has a ring shape or disc shape, wherein a diameter of the impeller hub is smaller than a diameter of the inlet flow guidance feature.

13. The cooling system of claim 10, wherein the inlet flow guidance feature is part of an enclosure of the computing device or attached to the enclosure of the computing device.

14. The cooling system of claim 10, wherein the inlet flow guidance feature is attached to and configured to rotate with the impeller hub.

15. The cooling system of claim 10, wherein the inlet flow guidance feature has a ring shape with a first edge and a second edge, wherein the curved surface of the inlet flow guidance feature continuously connects the first edge and the second edge.

16. The cooling system of claim 15, wherein the first edge meets a surface of an enclosure of the fan and the second edge is proximate the impeller hub.

17. The cooling system of claim 15, wherein the first edge is characterized as having a first diameter and the second edge is characterized as having a second diameter different than the first diameter.

* * * * *